US009914143B1

(12) United States Patent
Clark et al.

(10) Patent No.: US 9,914,143 B1
(45) **Date of Patent: *Mar. 13, 2018**

(54) DUAL TRAJECTORY NOZZLE FOR ROTOR-TYPE SPRINKLER

(71) Applicant: Hunter Industries, Inc., San Marcos, CA (US)

(72) Inventors: Michael L. Clark, San Marcos, CA (US); Zachary B. Simmons, Escondido, CA (US)

(73) Assignee: Hunter Industries, Inc., San Marcos, CA (US)

( * ) Notice: Subject to any disclaimer, the term of this patent is extended or adjusted under 35 U.S.C. 154(b) by 294 days.

This patent is subject to a terminal disclaimer.

(21) Appl. No.: 14/684,012

(22) Filed: Apr. 10, 2015

Related U.S. Application Data

(63) Continuation-in-part of application No. 14/599,762, filed on Jan. 19, 2015, now abandoned, which is a continuation of application No. 12/957,109, filed on Nov. 30, 2010, now Pat. No. 8,936,205.

(51) Int. Cl.
*B05B 1/02* (2006.01)
*B05B 15/10* (2006.01)
*B05B 15/06* (2006.01)

(52) U.S. Cl.
CPC ..... *B05B 15/065* (2013.01); *B05B 1/02* (2013.01); *B05B 15/10* (2013.01); *B05B 15/066* (2013.01)

(58) Field of Classification Search
CPC ..... B05B 15/10; B05B 15/065; B05B 15/066; B05B 15/069
USPC ..... 239/206, 391, 392, 397, 548, 553, 552, 239/600, 237, 240, 246–249, 587.1, 587.4
See application file for complete search history.

(56) References Cited

U.S. PATENT DOCUMENTS 5,086,977 A * 2/1992 Kah, Jr. ..... B05B 1/262 239/205
5,240,184 A * 8/1993 Lawson ..... B05B 1/34 239/237
5,598,977 A * 2/1997 Lemme ..... B05B 1/14 239/246

(Continued)

OTHER PUBLICATIONS

Toro, DT35 and DT55 Series Rotary Sprinklers Installation & Service Instructions, 12 pages, 2007.

(Continued)

*Primary Examiner* — Arthur O Hall
*Assistant Examiner* — Joseph A Greenlund
(74) *Attorney, Agent, or Firm* — Knobbe Martens Olson & Bear, LLP

(57) ABSTRACT

A sprinkler can include a nozzle turret having a removable nozzle carrier. For example, the nozzle carrier can be removably installed within a recess of a nozzle housing. The nozzle carrier can include one or more nozzle ports configured to receive sprinkler nozzles. The nozzles can have varying characteristics including flow rate, output range, spray pattern, etc. In some cases, a primary nozzle can be removably coupled with the nozzle carrier. The primary nozzle can include a body (e.g., inlet) portion having a first axis and a tapered (e.g., outlet) portion having a second axis non-parallel to the first axis. The primary nozzle can be configured to be installed in the nozzle carrier in at least two orientations. In some cases, one or more secondary nozzles are removably or permanently connected to the nozzle carrier.

20 Claims, 22 Drawing Sheets

(56) References Cited

U.S. PATENT DOCUMENTS 5,823,439 A * 10/1998 Hunter ..... B05B 3/0422 239/203
6,085,995 A * 7/2000 Kah, Jr. ..... B05B 1/1645 239/237
6,732,950 B2 * 5/2004 Ingham, Jr. ..... B05B 3/0436 239/205
7,017,831 B2 * 3/2006 Santiago ..... B05B 3/0431 239/200
7,226,003 B2 * 6/2007 Kah, Jr. ..... B05B 1/3026 239/200
8,177,148 B1 * 5/2012 Renquist ..... B05B 1/14 239/200
8,636,233 B2 * 1/2014 Clark ..... B05B 1/3006 137/527
8,888,023 B2 * 11/2014 Barton ..... B05B 1/02 239/397
8,936,205 B2 * 1/2015 Dunn ..... B05B 1/34 239/206
2003/0006306 A1 * 1/2003 Clark ..... B05B 3/0431 239/242
2003/0006307 A1 * 1/2003 Clark ..... B05B 3/0431 239/242
2005/0167526 A1 * 8/2005 McKenzie ..... B05B 1/304 239/225.1
2011/0017842 A1 * 1/2011 Nations ..... B05B 3/0418 239/251
2012/0132727 A1 * 5/2012 Dunn ..... B05B 1/34 239/518
2014/0252123 A1 * 9/2014 Anuskiewicz ..... B05B 15/10 239/205
2016/0136662 A1 * 5/2016 Clark ..... B05B 15/10 239/205
2016/0175858 A1 * 6/2016 Bell ..... B05B 3/0431 239/206

OTHER PUBLICATIONS

Toro, DT35/DT55 Series GOLF ROTORS, product brochure, 4 pages, 2009.

* cited by examiner

DUAL TRAJECTORY NOZZLE FOR ROTOR-TYPE SPRINKLER

RELATED APPLICATIONS

This application is a continuation-in-part of U.S. application Ser. No. 14/599,762, filed Jan. 19, 2015 which is a continuation of U.S. application Ser. No. 12/957,109, filed Nov. 30, 2010, now U.S. Pat. No. 8,936,205. The foregoing applications are hereby incorporated by reference in their entirety. Any and all priority claims identified in the Application Data Sheet, or any correction thereto, are hereby incorporated by reference under 37 CFR 1.57.

FIELD OF THE INVENTIONS

The present inventions relate to apparatus for irrigating turf and landscaping, and more particularly, to rotor-type sprinklers having a turbine that rotates a nozzle through a gear train reduction and a reversing mechanism with an adjustment for the arc of coverage.

BACKGROUND OF THE INVENTIONS

In many parts of the United States, rainfall is insufficient and/or too irregular to keep turf and landscaping green and therefore irrigation systems are installed. Such systems typically include a plurality of underground pipes connected to sprinklers and valves, the latter being controlled by an electronic irrigation controller. One of the most popular types of sprinklers to cover large areas of landscape is the pop-up rotor-type sprinkler. In this type of sprinkler a tubular riser is normally retracted into an outer cylindrical case by a coil spring. The case is buried in the ground and when pressurized water is fed to the sprinkler the riser extends telescopically in an upward direction. A turbine and a gear train reduction are mounted in the riser for rotating a nozzle turret at the top of the riser. The gear train reduction is sometimes encased in its own sub-housing which is referred to as a gear box. A reversing mechanism is also normally mounted in the riser along with an arc adjustment mechanism which is used to manually set the arc of coverage of the sprinkler nozzle.

The gear drive of a rotor-type sprinkler can include a series of staggered gears and shafts wherein a small gear on the top of the turbine shaft drives a large gear on the lower end of an adjacent second shaft. Another small gear on the top of the second shaft drives a large gear on the lower end of a third shaft, and so on. Alternately, the gear drive can comprise a planetary arrangement in which a central shaft carries a sun gear that simultaneously drives several planetary gears on rotating circular partitions or stages that transmit reduced speed rotary motion to a succession of similar rotating stages. It is common for the planetary gears of the stages to engage corresponding ring gears formed on the inner surface of the housing. See, for example, U.S. Pat. No. 5,662,545 granted to Zimmerman et al.

Rotor-type sprinklers can be designed to wet a full circle area around the sprinkler, or just part of a circle in which case an arc of pre-set angular dimension is covered by the stream of water ejected from the nozzle. Rotor-type sprinklers typically include at least one removable nozzle. Nozzles are typically available that change the amount of water being applied in terms of gallons per minute (GPM) and the radius or reach of the area being irrigated. The nozzle is installed into a cylindrical nozzle turret which is rotated at the top of the riser by the gear drive mechanism.

The nozzle turret has at least one nozzle port where the nozzle is inserted. See for example U.S. Pat. No. 5,699,962 granted Dec. 23, 1997 to Loren W. Scott et al. and assigned to Hunter Industries, Inc. the assignee of the subject application. The nozzle port is typically inclined to cause the stream of water ejected from the nozzle to be sent upwards and outwards from the sprinkler. It is common for the port in the nozzle turret to be inclined at about twenty-five degrees relative to the surface of the surrounding landscape.

There are times when the sprinkler is installed in a landscape area where there is a hill in front of the sprinkler that may interfere with the stream of water spraying out of the sprinkler. It is common for an installer to install the sprinkler at an angle to the horizon to allow the sprinkler to shoot over the hill. This may require an additional sprinkler to irrigate the flat area in front of the hill. Other times, the sprinkler may be installed in an area with wind that carries the water off if it is emitted at too high of an angle. Manufactures often supply specially design low angle nozzles for this application that cause the stream to exit the sprinkler at a lower trajectory. A lower trajectory may also be required if low overhanging vegetation like tree limbs get in the way of a high trajectory and interfere with the irrigation process.

SUMMARY OF THE INVENTIONS

In accordance with the present inventions, a nozzle can be inserted in one of two positions to either increase or decrease the trajectory of the stream of water leaving a sprinkler. The water leaves the nozzle at a different angle than when it enters the nozzle. The angel of the exit section of the nozzle is different from the entrance section of the nozzle.

According to some variants, a nozzle turret assembly for an irrigation sprinkler can include a nozzle housing. In some cases, the assembly has a nozzle carrier configured to releasably mate with the nozzle housing. The nozzle carrier can include an outer face facing away from the nozzle housing when the nozzle carrier is mated with the nozzle housing. In some cases, the nozzle carrier includes an inner face positioned at least partially within the nozzle housing when the nozzle carrier is mated with the nozzle housing. The nozzle carrier can include a primary nozzle port extending through the outer face and the inner face of the nozzle carrier and having a primary port axis. In some embodiments, the nozzle carrier includes a first secondary nozzle port extending through the outer face and the inner face of the nozzle carrier. The nozzle turret assembly can include a primary nozzle configured to releasably mate with the primary nozzle port of the nozzle carrier. The primary nozzle can include an inlet portion defining an inlet axis and a tapered outlet portion connected to the inlet portion and defining an outlet axis, the tapered outlet configured to output water in a trajectory parallel to the outlet axis, the inlet axis being parallel to the primary port axis and the outlet axis being non-parallel to the primary port axis.

In some embodiments, the primary nozzle is configured to releasably mate with the primary nozzle port of the nozzle carrier in a first orientation and in a second orientation. In some cases, the primary nozzle outputs water at a higher trajectory in the first orientation than in the second orientation. In some embodiments, the first secondary nozzle port includes a head water nozzle configured to output water up to a first distance and a second secondary nozzle port including a mid-range secondary nozzle configured to output water up to a second distance, the second distance being greater than the first distance. In some cases, the mid-range secondary nozzle is configured to output water between a third distance and the second distance. In some embodiments, the third distance is less than or equal to the first distance. In some cases, the primary nozzle is configured to output water between a fourth distance and a fifth distance, wherein the fourth distances is less than or equal to the second distance, and wherein the fifth distance is greater than the second distance.

In some cases the nozzle carrier includes a second secondary nozzle port extending through the outer face and the inner face of the nozzle carrier. The nozzle carrier can include a first secondary nozzle. In some embodiments, the nozzle carrier includes a second secondary nozzle. In some cases, one or more of the first and second secondary nozzles are configured to releasably mate with one or more of the first and second secondary nozzle ports. In some embodiments, each of the primary nozzle, first secondary nozzle, and second secondary nozzle is mated with or released from the nozzle housing when the nozzle carrier is mated with or released from the nozzle housing.

According to some variants, a nozzle turret assembly for an irrigation sprinkler can include a nozzle turret housing having a turret interior. The nozzle turret housing can include a first end configured to mate with a riser assembly of an irrigation sprinkler, a second end, a housing axis extending between the first end and the second end of the nozzle turret, and at least one lateral wall spaced from the housing axis. In some embodiments, the nozzle turret housing includes a carrier cavity in the at least one lateral wall and open to an exterior of the nozzle turret. The nozzle turret housing can include a primary nozzle bore in the carrier cavity. In some cases, the nozzle turret housing include at least one secondary nozzle bore. In some cases, the nozzle turret assembly includes a nozzle carrier configured to couple with the carrier cavity in the at least one lateral wall of the nozzle turret housing. In some cases, the nozzle carrier includes a primary nozzle port. The nozzle carrier can include a first secondary nozzle port separate from the primary nozzle port and configured to align with the at least one secondary nozzle bore. In some embodiments, the nozzle turret assembly includes a primary nozzle having an inlet and an outlet. In some embodiments, an axial centerline of the inlet is non-parallel to an axial centerline of the outlet. The primary nozzle can be configured to couple with the primary nozzle bore in the carrier cavity and to extend through at least a portion of the primary nozzle port when the primary nozzle and nozzle carrier are coupled with the carrier cavity.

In some embodiments, the primary nozzle port includes a flange configured to limit a distance the primary nozzle can be inserted into the primary nozzle port. In some cases, the primary nozzle bore includes an abutment structure configured to limit a distance the primary nozzle can be inserted into the primary nozzle port. In some embodiments, the primary nozzle is configured to couple with the primary nozzle bore and with the primary nozzle port without any attachment structure. In some embodiments, the primary nozzle port includes one or more orientation structures. In some cases, the primary nozzle includes one or more orientation structures. The one or more orientation structures of the primary nozzle port can be configured to engage with the one or more orientation structures of the primary nozzle to inhibit rotation of the primary nozzle with respect to the primary nozzle port when the primary nozzle is coupled with the primary nozzle port and the nozzle carrier is coupled with the carrier cavity. In some cases, the orientation structures of the primary nozzle port and of the primary nozzle include at least one protrusion and at least one recess configured to couple with the at least one protrusion.

According to some variants, a nozzle turret assembly for an irrigation sprinkler can include a nozzle housing having a sidewall. The assembly can include a cavity within the nozzle housing and accessible through an opening in the sidewall. In some embodiments, the assembly includes a primary nozzle bore in the cavity, the primary nozzle bore having an inner wall. In some cases, the assembly includes a nozzle carrier configured to releasably mate with the nozzle housing. The nozzle carrier can include a nozzle carrier body having a front surface and a back surface. In some embodiments, the back surface is positioned at least partially within the cavity when the nozzle carrier is mated with the nozzle housing. In some cases, the nozzle carrier includes a primary nozzle port extending through the front and back surfaces of the nozzle carrier body. The assembly can include a primary nozzle having a base portion having a central axis and defining an inlet. The primary nozzle can have a tapered portion having a central axis non-parallel to the central axis of the base portion. The tapered portion can be connected to the base portion and can define an outlet of the primary nozzle. In some embodiments, the primary nozzle is configured to fit at least partially within the primary nozzle port from the back surface of the nozzle carrier body.

In some embodiments, the nozzle housing includes a water inlet and a primary nozzle chamber in fluid communication with the primary nozzle bore and with the water inlet. In some cases, the primary nozzle chamber includes a chamber wall defining at least a portion of the primary nozzle bore. In some embodiments, the base portion of the primary nozzle is configured to fit at least partially within the primary nozzle bore. In some cases, the chamber wall is configured to inhibit passage of water beyond a leading edge of the base portion of primary nozzle other than through inlet of the primary nozzle.

In some cases, one or more flow-straightening fins extend inwardly from the inner wall of the primary nozzle bore. In some embodiments, the assembly includes a secondary nozzle bore in the cavity. In some cases, the assembly includes a slot formed within the cavity. The slot can be at least partially defined by the sidewall of the cavity. In some embodiments, the nozzle carrier comprises a mating tab configured to releasably connect to the slot. In some cases, the mating tab is configured to flex during installation and during removal of the nozzle carrier from the nozzle housing. In some embodiments, the base portion of the primary nozzle is configured to flex during installation and during removal of the nozzle carrier from the housing when the primary nozzle is installed in the primary nozzle port. In some cases, the slot includes a cut-away portion sized and shaped to permit insertion of a tool between the tab and a wall of the slot during installation and during removal of the nozzle carrier from the housing.

DETAILED DESCRIPTION OF THE PREFERRED EMBODIMENT

Figure 1:
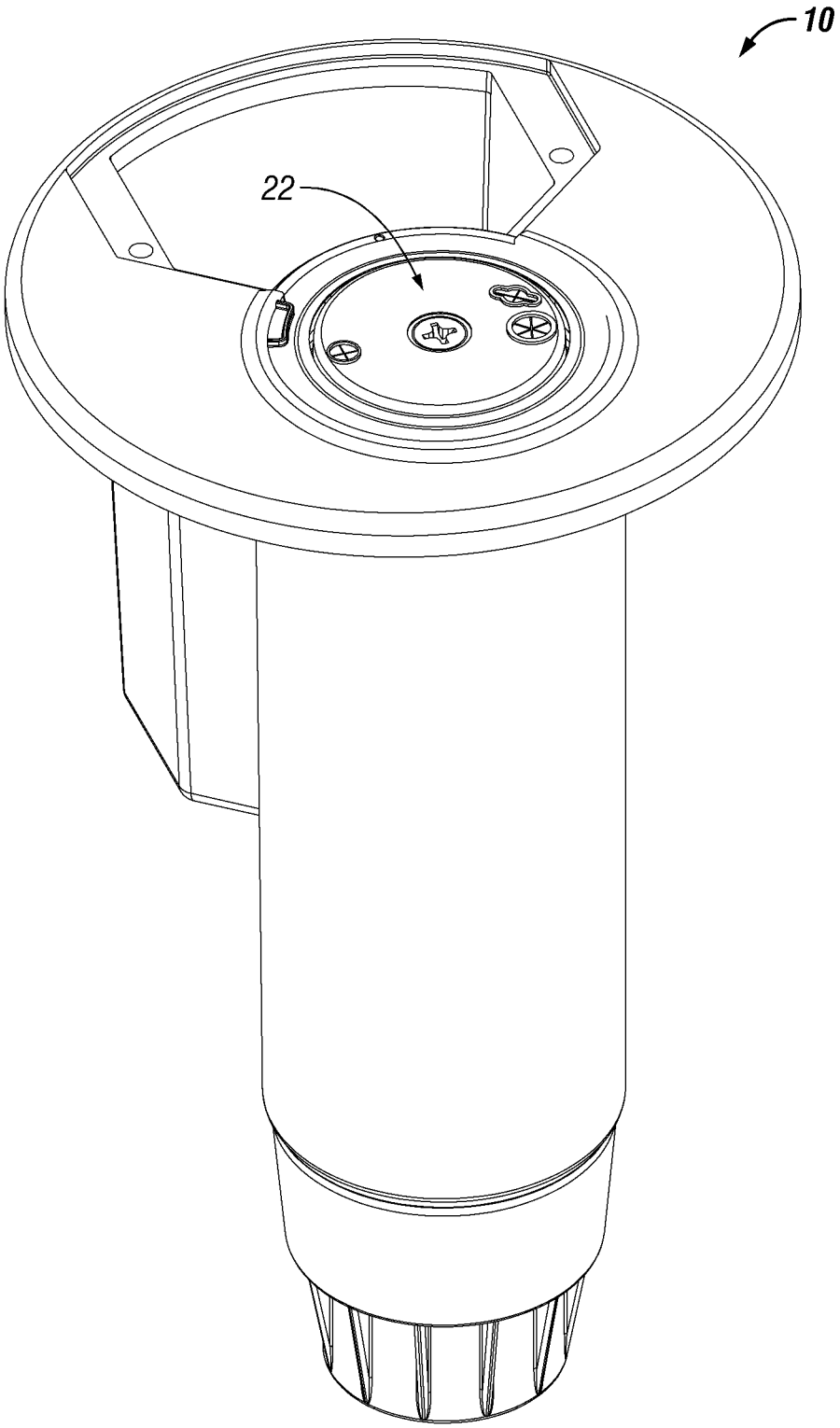
FIG. 1 is an isometric view of a pop-up rotor-type sprinkler in accordance with an embodiment of the present inventions viewed from its top side.
Figure 2:
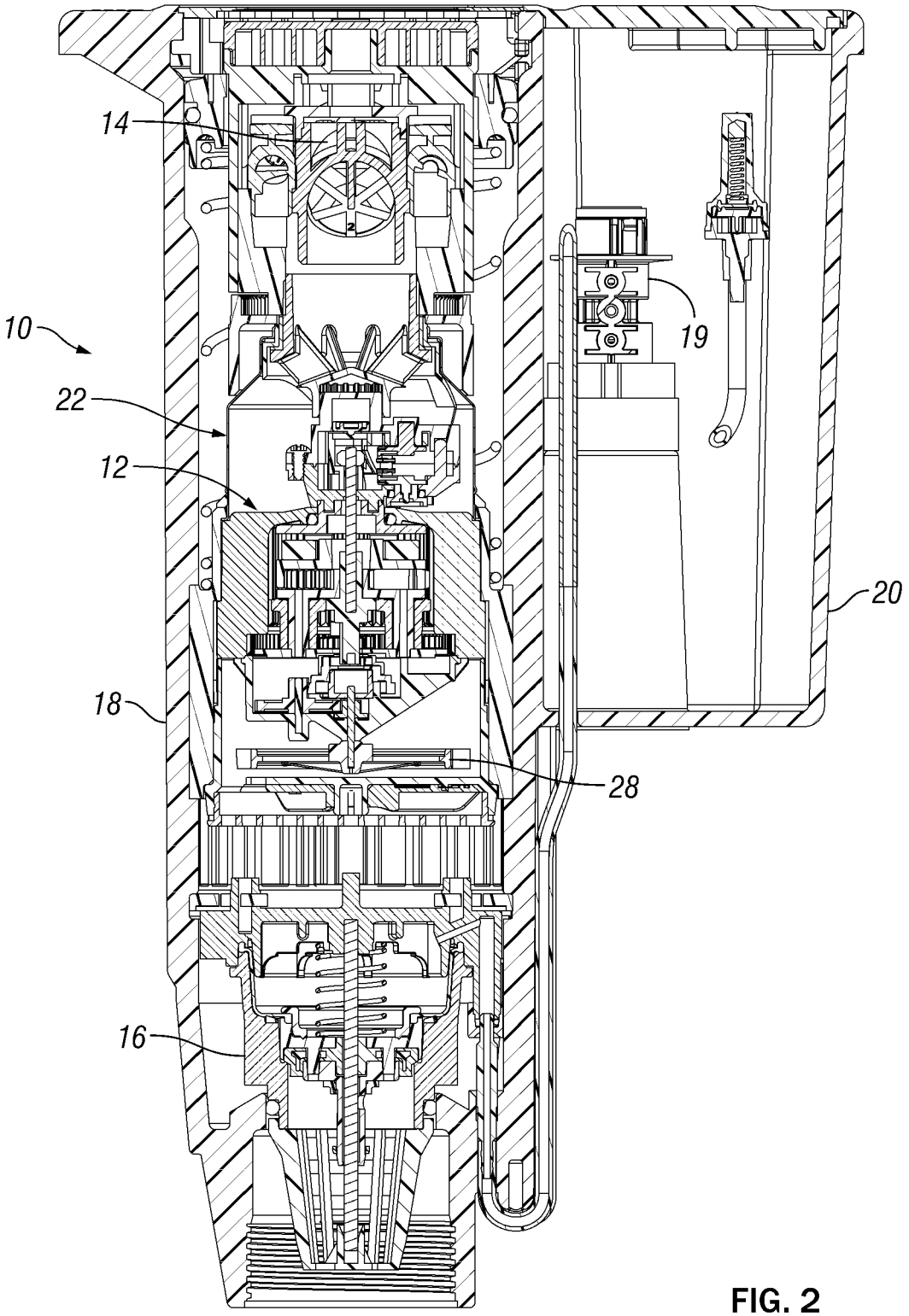
FIG. 2 is a vertical sectional view of the sprinkler of FIG. 1.

Referring to FIG. 1, in accordance with an embodiment of the present inventions a rotor-type sprinkler 10 includes an outer housing 18 and a riser assembly 22. The sprinkler 10 incorporates a reversing planetary gear drive 12 (FIG. 2) that rotates or oscillates a nozzle 14 between pre-set arc limits. Except for the reversing planetary gear drive 12, and an additional reversing mechanism 13 (FIG. 3) located externally of the reversing planetary gear drive 12, the sprinkler 10 generally has a construction similar to that disclosed in U.S. Pat. No. 6,491,235 granted Dec. 10, 2002 to Lauren D, Scott et al. and assigned to Hunter Industries, Inc., the entire disclosure of which is hereby incorporated by reference. Except for the metal springs, the other components of the sprinkler 10 are generally made of injection molded plastic. The sprinkler 10 is a so-called valve-in-head sprinkler that incorporates a valve 16 in the bottom of a cylindrical outer case 18 which is opened and closed by valve actuator components 19 contained in a housing 20 on the side of the case 18. The sprinkler 10 includes a generally tubular riser 22. A coil spring 24 normally holds the riser 22 in a retracted position within the outer case 18. The nozzle 14 is carried inside a cylindrical nozzle turret 26 rotatably mounted at the upper end of the riser 22. The coil spring 24 is compressible to allow the riser 22 and nozzle turret 26 to telescope from their retracted positions to their extended positions when pressurized water is introduced into the female threaded inlet at the lower end of the outer case 18.

Figure 3:
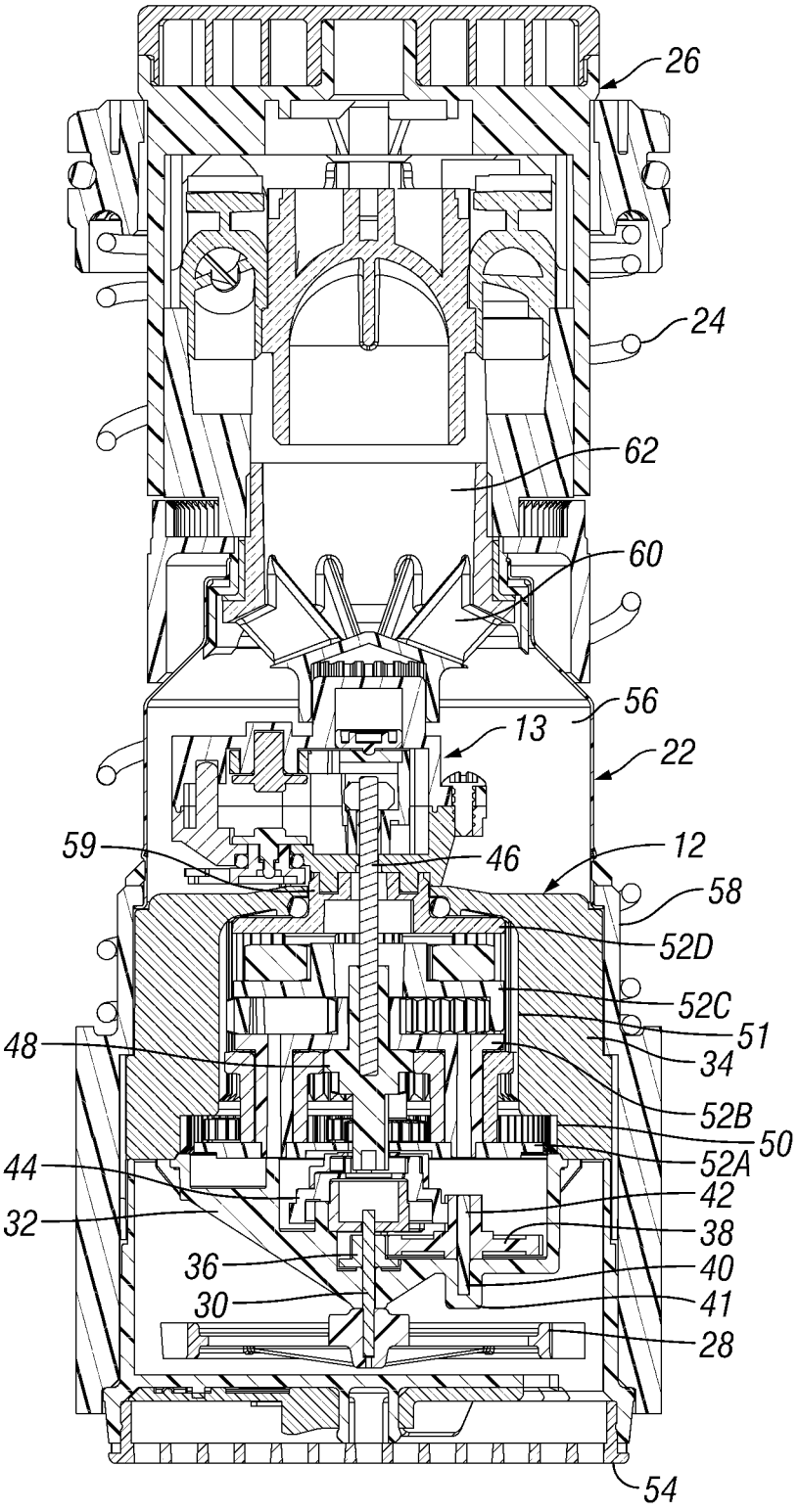
FIG. 3 is an enlarged vertical sectional view of the riser and nozzle turret of the sprinkler of FIG. 1.

FIG. 3 illustrates further details of the riser 22, nozzle turret 26 and reversing planetary gear drive 12. A turbine 28 is rigidly secured to the lower end of a vertically oriented drive input pinion shaft 30. The pinion shaft 30 extends through the lower cap 32 of a cylindrical gear box housing 34 of the reversing planetary gear drive 12. A turbine pinion gear 36 is rigidly secured to the upper end of the pinion shaft 30. The turbine pinion gear 36 drives a lower spur gear 38 secured to a spur gear shaft 40. The lower end of the spur gear shaft 40 is journaled in a sleeve 41 integrally formed in the lower cap 32. Another pinion gear 42 is integrally formed on top of the spur gear 38 and drives an upper spur gear 44 of the reversing planetary gear drive 12. Thus the turbine 28 is coupled to an input stage of the planetary gear drive 12.

Referring still to FIG. 3, the reversing planetary gear drive 12 has a centrally located main control shaft 46. The lower end of the control shaft 46 is rigidly and co-axially coupled to a bi-level shift sun gear 48 which is vertically reciprocated by axial movement of the control shaft 46 between a raised state illustrated in FIGS. 2 and 13 and a lowered state. The interior wall of the cylindrical gear box housing 34 is formed with two axially displaced ring gears 50 and 51. Each of the ring gears 50 and 51 comprises a plurality of circumferentially spaced, vertically extending, radially inwardly projecting teeth that are engaged by the various planet gears of the reversing planetary gear drive 12. The lower ring gear 50 has a larger diameter and more teeth than the upper ring gear 51. The upper ring gear 51 has a larger axial length than the lower ring gear 50. Together the ring gears 50 and 51 form a bi-level ring gear.

The reversing planetary gear drive has a construction similar to that disclosed in U.S. Pat. No. 7,677,469 granted Mar. 16, 2010 to Michael L. Clark and assigned to Hunter Industries, Inc., the entire disclosure of which is hereby incorporated by reference. Further details are disclosed in co-pending U.S. patent application Ser. No. 12/710,298 filed Feb. 22, 2010 in the names of Michael L. Clark et al. and entitled "Irrigation Sprinkler with Reversing Planetary Gear Drive Including Two Ring Gears with Different Profiles" and co-pending U.S. patent application Ser. No. 12/710,265 also filed Feb. 22, 2010 in the names of Michael L. Clark et al. entitled "Reversing Mechanism for an Irrigation Sprinkler With a Reversing Planetary Gear Drive", the entire disclosures of both which are hereby incorporated by reference.

The reversing planetary gear drive 12 further includes additional sun gears and planet gears. The other planet gears also engage the ring gears 50 and 51 and rotate about corresponding fixed cylindrical posts that extend vertically from their associated disc-shaped carriers 52A, 52B, 52C and 52D. Each non-shifting sun gear is rigidly secured to, or integrally formed with, one of the carriers 52B, 52C and 52D. The uppermost carrier 52D has an upwardly projecting central section 59 (FIG. 3) that is coupled to the underside of the reversing mechanism 13 in order to rotate the same. The reversing mechanism 13 in turn supports and rotates the nozzle turret 26. With this arrangement of gears the high RPM of the turbine 28 is successively reduced so that the final output RPM of the control shaft 46 is relatively low, and the output torque at the central section 59 of the uppermost carrier 52D is relatively high. For example, the turbine 28 may rotate at eight hundred RPM and the output shaft 46 may rotate at an RPM of less than one.

Figure 4:
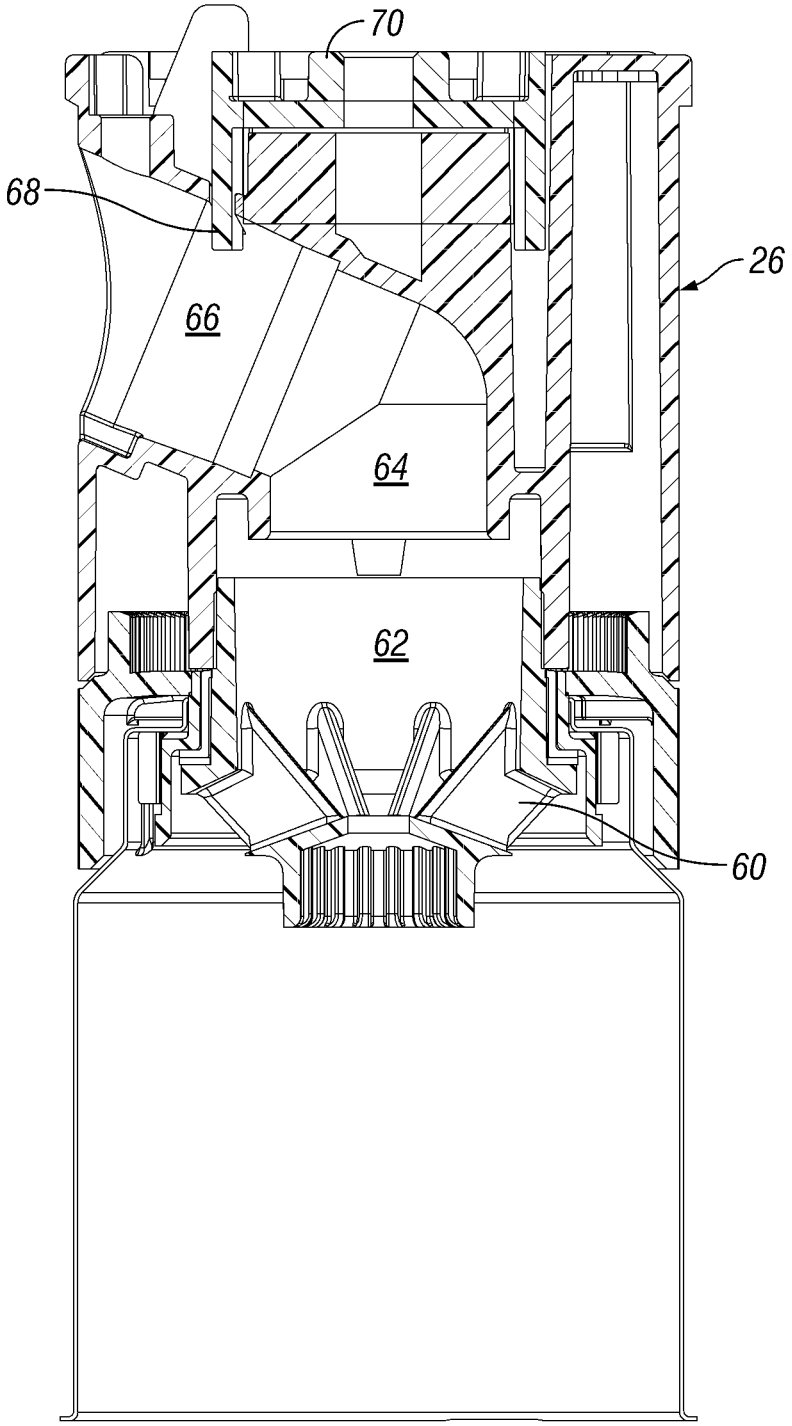
FIG. 4 is an enlarged vertical sectional view of the nozzle turret of the sprinkler of FIG. 1 rotated ninety degrees about its vertical axis relative to the orientation illustrated in FIG. 3.
Figure 5:
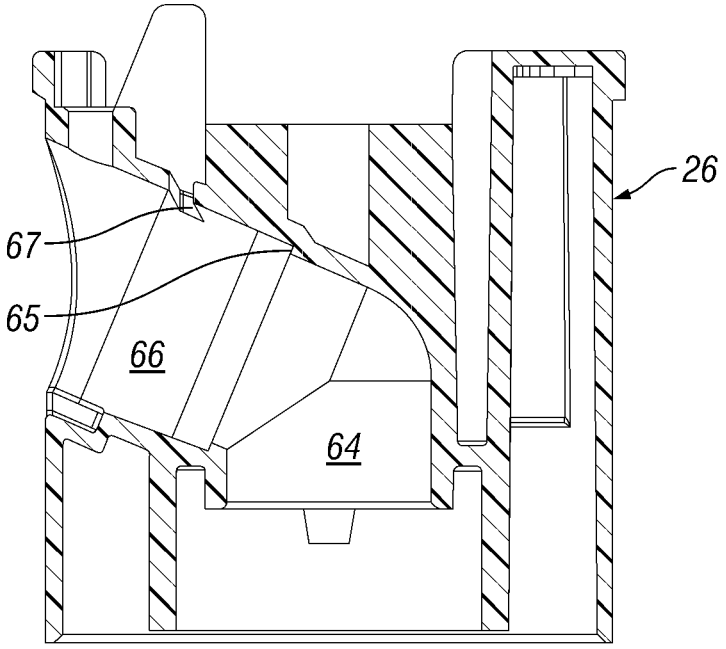
FIG. 5 is an enlarged portion of FIG. 4 illustrating further details of the nozzle turret of the sprinkler of FIG. 1 with the nozzle removed.

The fast spinning turbine 28 can slowly rotate the nozzle turret 26 through the reversing planetary gear drive 12 and the additional reversing mechanism 13. The gearbox housing 34 includes a plurality of circumferentially spaced fins (not illustrated) that support the gearbox housing 34 within the riser sleeve 58 and allow water to flow from the inlet screen 54, past the turbine 28 and then between the fins into chamber 56 (FIG. 3). Water then flows between a plurality of supporting fins 60 in into a chamber 62 and directly to a cylindrical nozzle turret primary port 64 (FIG. 4). FIG. 4 is rotated ninety degrees from the orientation in FIG. 3 for clarity. The nozzle turret primary port 64 leads to a cylindrical nozzle turret exit port 66 that is inclined at roughly a twenty degree angle relative to a plane intersecting the vertical axis of the nozzle turret primary port 64 in perpendicular fashion. A retainer tab 68 is attached to a secondary port holder 70. When the secondary part holder 70 is attached to the top of the turret 26, the retainer tab 68 protrudes through a slot 67 (FIG. 5) in the nozzle turret exit port 66 to retain the nozzle 14 in place for normal operation. Secondary port holder 70, including retainer tab 68 can be manually withdrawn from the nozzle turret 26 to permit removal or insertion of the nozzle 14 into the nozzle turret 26. Retainer tab 68 slides through the slot 67 and into a retainer cavity 72*a* or 72*b* (FIG. 10) to retain the nozzle 14 in its correct radial orientation and to prevent the nozzle 14 from coming out of the nozzle turret 26 during normal operation of the sprinkler 10.

Figure 6:
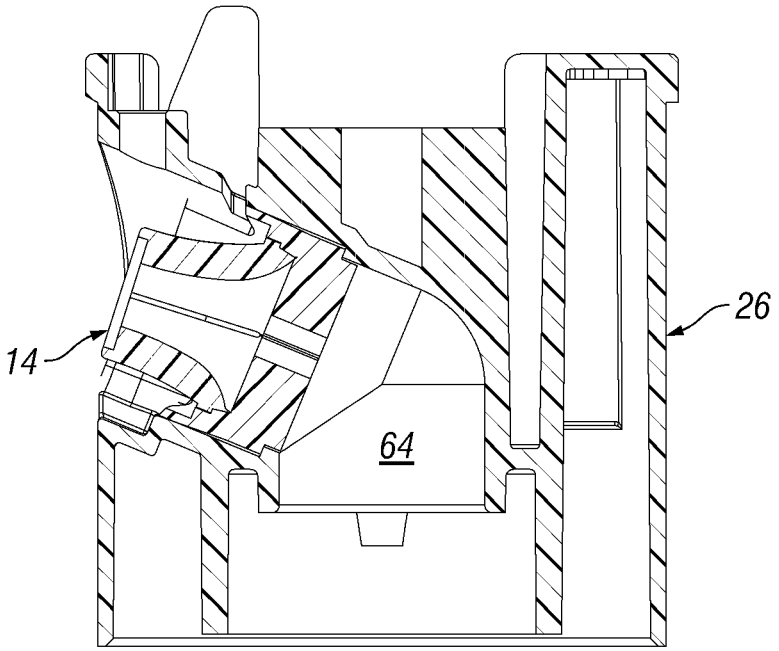
FIG. 6 is a view of the nozzle turret similar to FIG. 5 with the dual trajectory nozzle installed in its low trajectory orientation.

FIG. 6 illustrates the nozzle 14 installed into the nozzle turret 26 oriented for a low outlet trajectory as the outlet of nozzle 14 is at a lower angle than the exit port 66 of the nozzle turret 26. The central longitudinal axis of the nozzle 14 is orientated so the retainer cavity 72*a* is positioned at the top of the nozzle turret 26 where it is retained by the nozzle retainer tab 68.

Figure 7:
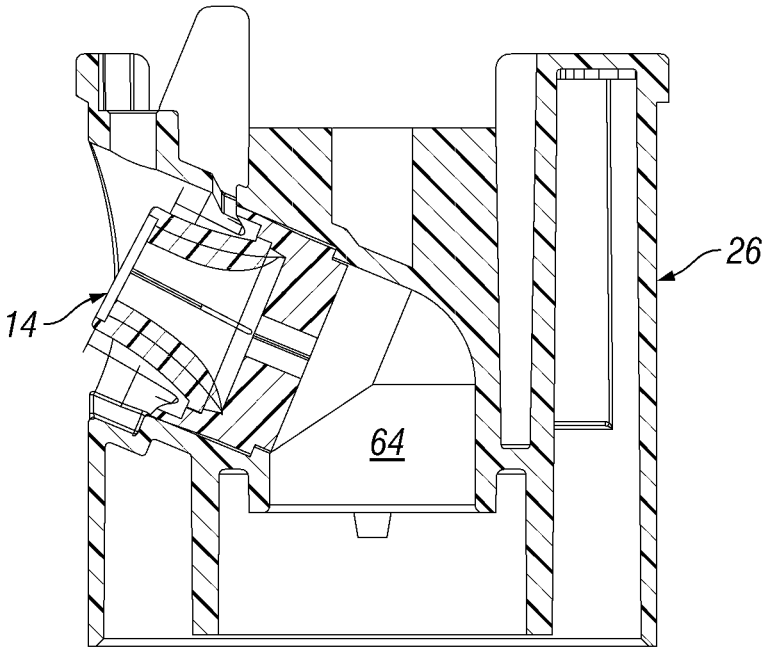
FIG. 7 is a view similar to FIG. 6 with the dual trajectory nozzle installed in its high trajectory orientation.

FIG. 7 illustrates the nozzle 14 installed in the nozzle turret 26 oriented for a high outlet trajectory as the outlet port 66 of the nozzle 14 is at a higher angle than the exit port of the nozzle turret. In this installation the central longitudinal axis of the nozzle 14 is orientated one hundred and eighty degrees from the orientation illustrated in FIG. 6 such that the ret retainer cavity 72*b* is at the top of the nozzle turret 26 where it is retained by the nozzle retainer tab 68.

Figure 8:
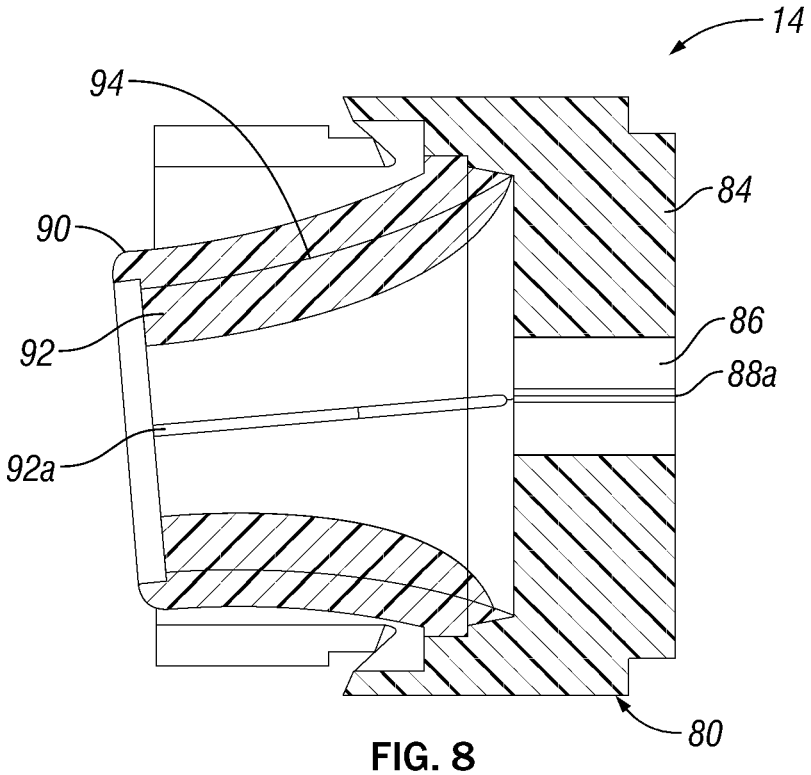
FIG. 8 is an enlarged sectional view of the dual trajectory nozzle illustrated in FIGS. 6 and 7 after it has been removed from the nozzle turret.
Figure 9:
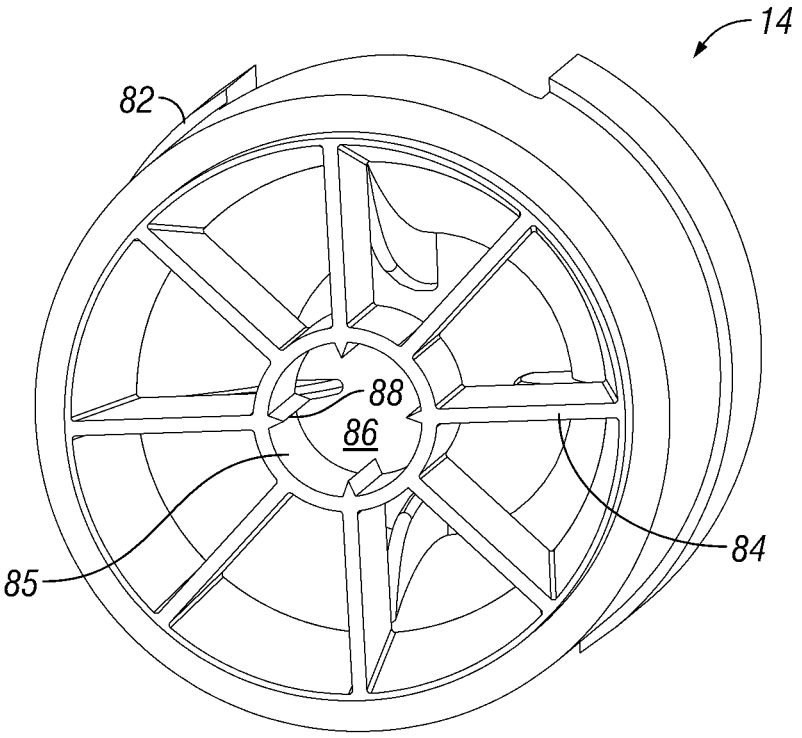
FIG. 9 is an enlarged isometric view of the inlet end of the dual trajectory nozzle illustrated in section in FIG. 8.
Figure 10:
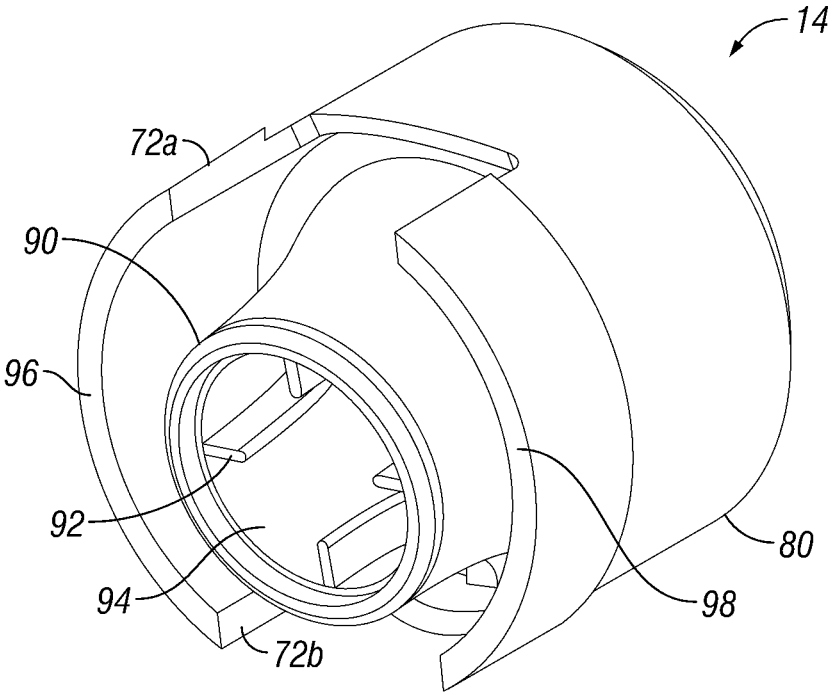
FIG. 10 is an enlarged isometric view of the outlet end of the dual trajectory nozzle illustrated in FIGS. 8 and 9.
Figure 11:
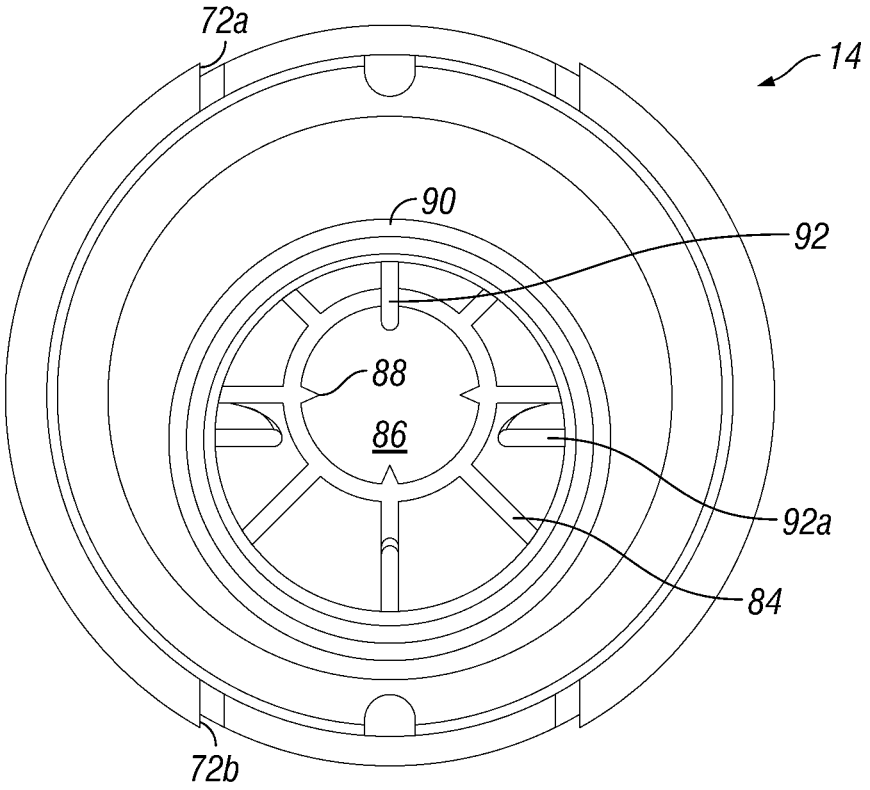
FIG. 11 is an enlarged front end view of the dual trajectory nozzle illustrated in FIGS. 8-10.

Referring to FIG. 8, the nozzle 14 has a generally cylindrical configuration and is comprised of two primary sections. The first section is provided by an inlet base 80 which includes a plurality of radially extending stream straightening fins 84 (FIG. 9), a ring-shaped member 85 defining a center port 86 and a plurality of V-shaped stream straightening tabs 88 formed on the inner wall of the ring-shaped member 85. These structures work together to reduce turbulence in the stream of water entering the nozzle 14. Removing the turbulence from the water is important to maximize the range that the water will reach after it leaves the nozzle 14. The second section of the nozzle 14 includes a tapered outlet spout 90 which includes a plurality of stream straightening fins 92 formed on an elliptical inner wall 94 of the tapered spout 90. The retainer cavities 72*a* and 72*b* are defined by a pair of axially aligned opposing semi-circular skirts 96 and 98 (FIG. 10). When the retainer tab 68 is not inserted in the slot 67, the cylindrical base 80 can be inserted in the exit port 64 of the nozzle turret 26 until a shoulder 82 (FIG. 8) on the rear end thereof engages a complementary shoulder 65 that forms the transition between the primary port 64 and the exit port 66 in the nozzle turret 26. Thus the exit port 66 functions as a socket for removably receiving the nozzle 14.

The combination of the elliptical inner wall 94 (FIG. 8) and the stream straightening fins 92 serves to keep turbulence to a minimum while changing direction of flow and accelerating the water prior to exiting the nozzle 14. The change of direction is most evident by observing the angular difference of the stream straightening fin 92*a* in FIG. 8 and the stream straightening tab 88*a*. The angular difference in this example is approximately five degrees. The outlet port 66 in the nozzle turret 26 may be manufactured at an exit angle of approximately twenty degrees, but the stream of water leaving nozzle spout 90 will be oriented so that it extends at an angle of approximately fifteen degrees relative to the surrounding ground if the retaining cavity 72*a* is upwardly oriented, or approximately twenty-five degrees if retaining cavity 72*b* is upwardly oriented. This allows a user to set the proper trajectory of the sprinkler 10 as required for the particular needs of the landscape being irrigated without having to choose from different nozzles. Turbulence in the delivery of water through a sprinkler significantly reduces the effectiveness of the sprinkler. The transition from vertical to twenty degree off horizontal is accomplished within the nozzle turret 26 between inlet chamber 64 and outlet port 66. It is important to maintain a smooth laminar flow of the water exiting the sprinkler 10. By having the inlet section of the nozzle 14 accept water directly in line with the flow the nozzle turret 26 causes the water to maintain its maximum velocity as it makes a smooth transition from the primary port 64 to the nozzle 14. Controlling the change of direction within the nozzle 14 to a higher or lower angle keeps the water flowing without excessive turbulence and produces a well-controlled distribution of water out of the nozzle.

Figure 12:
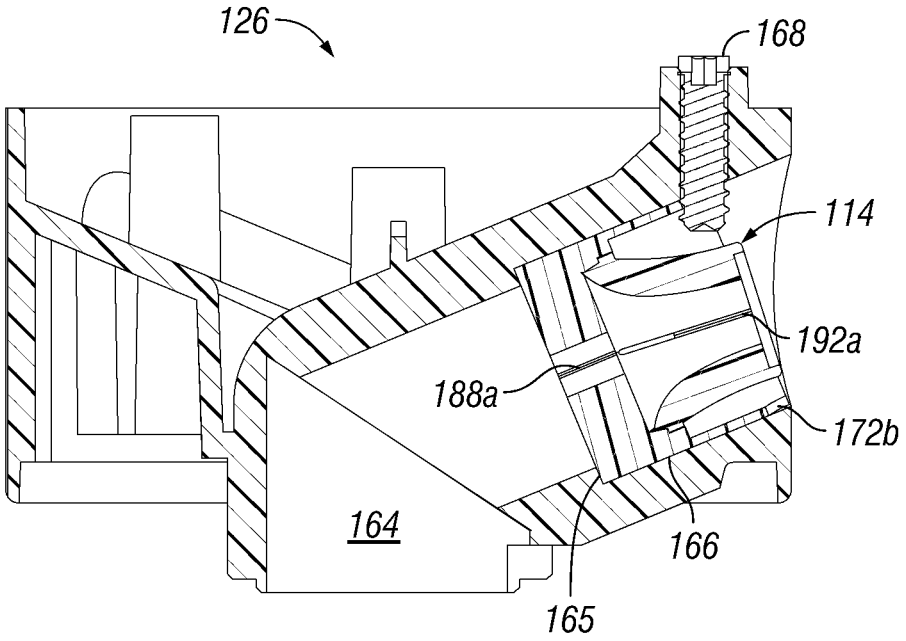
FIGS. 12 and 13 are sectional and isometric views of an alternate embodiment, respectively.

FIG. 12 illustrates an alternate embodiment of a nozzle 114 installed into an alternate nozzle turret 126 oriented for a low outlet trajectory. The outlet of the nozzle 114 is at a lower angle than the exit port 166 of the nozzle turret 126. The central longitudinal axis of the nozzle 114 is orientated so that the retainer cavity 172*a* (FIG. 13) is positioned at the top of the nozzle turret 126 where it is retained by a nozzle retainer screw 168. The primary difference in between the nozzle 114 and the nozzle 14 is that the outer cylindrical base 180 of the nozzle 114 is smooth to facilitate insertion into a smooth exit port 166 of the nozzle turret 126. In addition, the nozzle 114 incorporates the retention screw 168 to retain the nozzle 114 in position and smaller slots 172*a* and 172*b* to mate with the retention screw 166.

Figure 13:
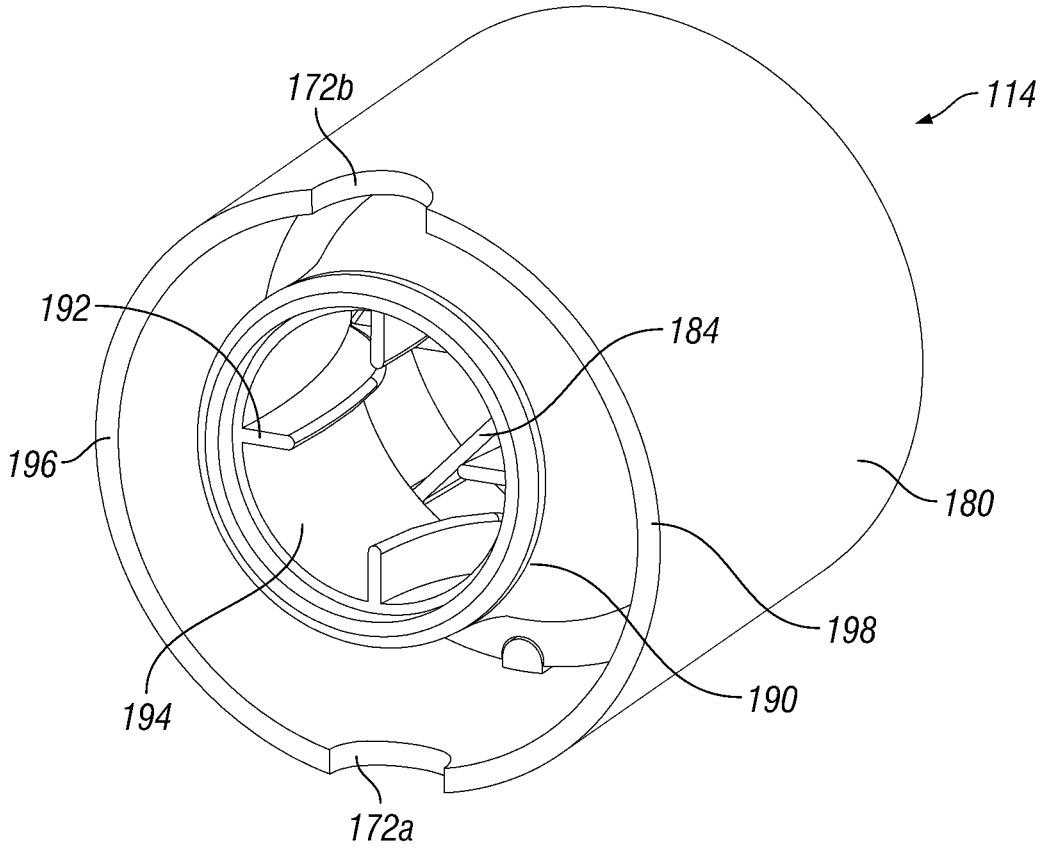

FIG. 13 illustrates the nozzle 114 oriented for a high outlet trajectory operation as the outlet port 194 of the nozzle 114 is at a higher angle than the central axis of its cylindrical base 180. In this figure, the retainer cavity 172*b* is located at the twelve o'clock position where it could be retained by the retention screw 168 if it were inserted into the nozzle turret 126 in this orientation.

Referring still to FIG. 13, the nozzle 114 has a generally cylindrical configuration and is comprised of two primary sections. The first section is provided by the smooth cylindrical inlet base 180 which includes a plurality of radially extending stream straightening fins 184. The nozzle 114 includes this same internal design as the nozzle 14 illustrated in FIG. 9. The retainer cavities 172*a* and 172*b* are defined by a pair of axially aligned opposing semi-circular skirts 196 and 198. When the retainer screw 168 is sufficiently unscrewed, the cylindrical base 180 can be inserted in the exit port 166 of the nozzle turret 126 until the rear end thereof engages a shoulder 165 (FIG. 12) that forms the transition between the primary port 164 and the exit port 166 in the nozzle turret 126. Thus the exit port 166 functions as a socket for removably receiving the nozzle 14. After insertion, the retaining screw 166 is simply turned until the lower segment of the screw 168 protrudes far enough into the exit port 166 to retain the nozzle 114.

As illustrated in the first embodiment, the combination of the elliptical inner wall 194 and the stream straightening fins 192 serves to keep turbulence to a minimum while changing direction of flow and accelerating the water prior to exiting the nozzle 114. The change of direction is most evident by observing the angular difference of the stream straightening fin 192*a* in FIG. 12 and the stream straightening tab 188*a*. The angular difference in this example is approximately five degrees. The exit port 166 in the nozzle turret 126 may be manufactured at an exit angle of approximately twenty degrees, but the stream of water leaving nozzle spout 90 will be oriented so that it extends at an angle of approximately fifteen degrees relative to the surrounding ground if the retaining cavity 172*a* is upwardly oriented, or approximately twenty-five degrees if retaining cavity 172*b* is upwardly oriented. This allows a user to set the proper trajectory of the sprinkler 10 as required for the particular needs of the landscape being irrigated without having to choose from different nozzles. It is important to maintain a smooth laminar flow of the water exiting the sprinkler 10. Controlling the change of direction within the nozzle 114 to a higher or lower angle keeps the water flowing without excessive turbulence and produces a well-controlled distribution of water out of the nozzle.

Figure 14:
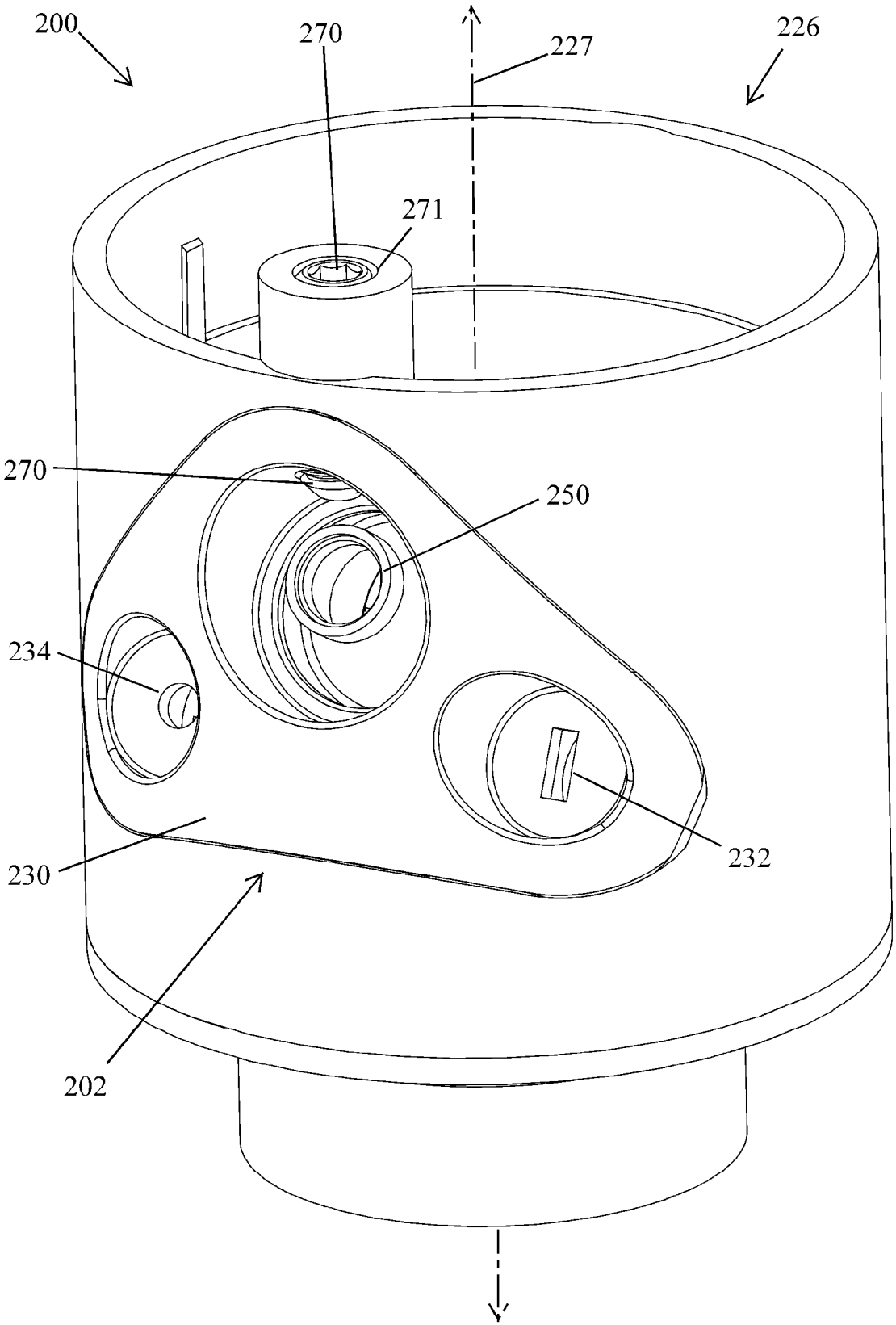
FIG. 14 is a perspective view of an embodiment of a nozzle turret assembly.
Figure 15:
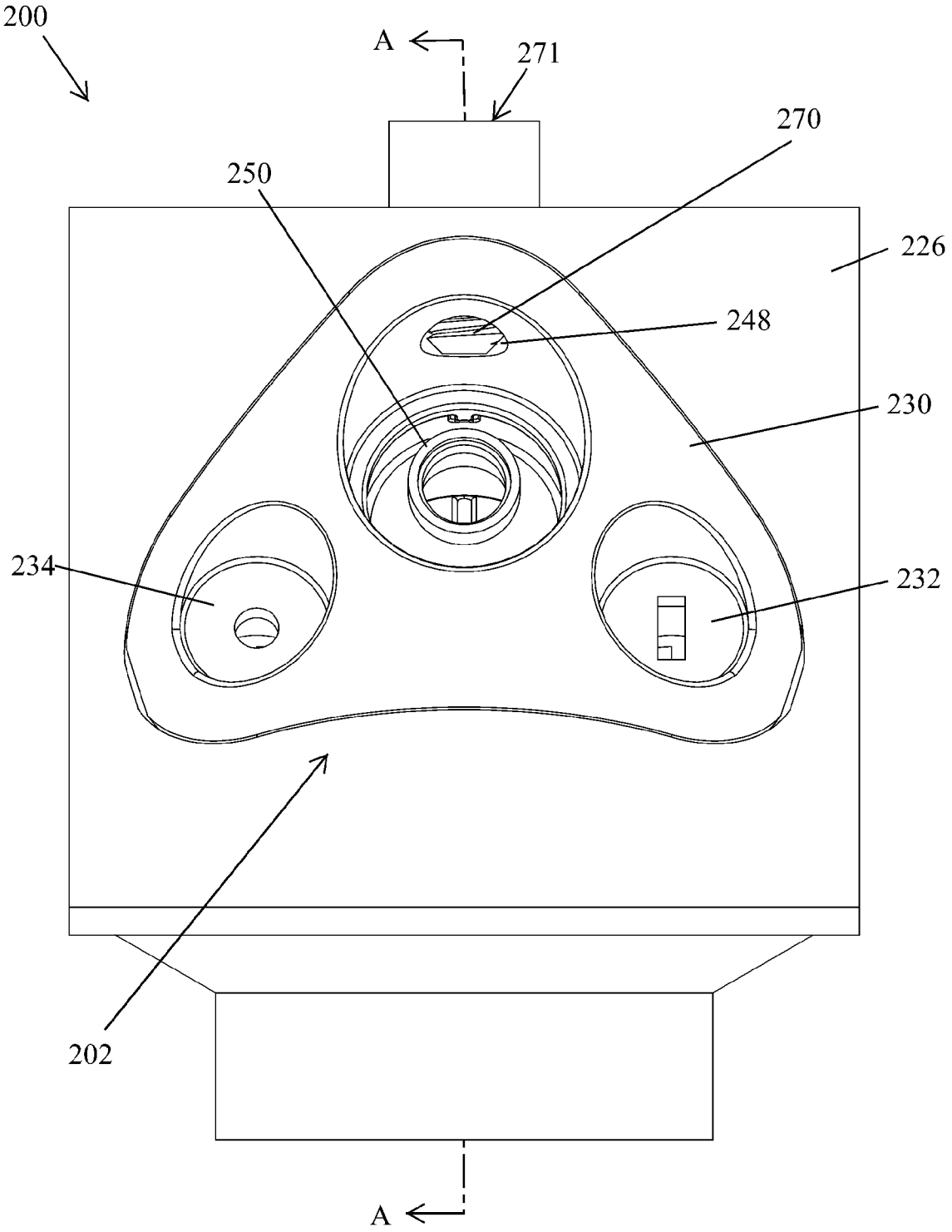
FIG. 15 is a front plan view of the assembly of FIG. 14.

FIGS. 14 and 15 illustrate an embodiment of a nozzle turret assembly 200 that includes some similarities and some differences with the nozzle turrets and nozzles described above. In some cases, the nozzle turret assembly 200 includes a nozzle housing 226 (e.g., nozzle turret housing) having an interior. The nozzle turret housing 226 can include an inlet configured to mate with another component (e.g., a riser assembly) of a sprinkler. In some cases, the nozzle housing 226 includes a nozzle housing axis 227 (e.g., a centerline or longitudinal axis). The nozzle housing 226 can be configured to releasably mate with a nozzle carrier 230 having one or more nozzles. One or more of the nozzles can be configured to releasably mate with the nozzle carrier 230. In some cases, one or more of the nozzles can have an inlet portion having an inlet axis offset from an outlet axis of the outlet portion of the nozzle.

As illustrated, the nozzle turret assembly 200 can include a nozzle assembly 202. The nozzle assembly 202 can include a nozzle carrier 230. The nozzle carrier 230 can be configured to releasably connect with the nozzle housing 226. For example, the nozzle carrier 230 can be configured to fit at least partially within a nozzle recess 204 (FIG. 16) in a sidewall of the nozzle housing 226.

Figure 17:
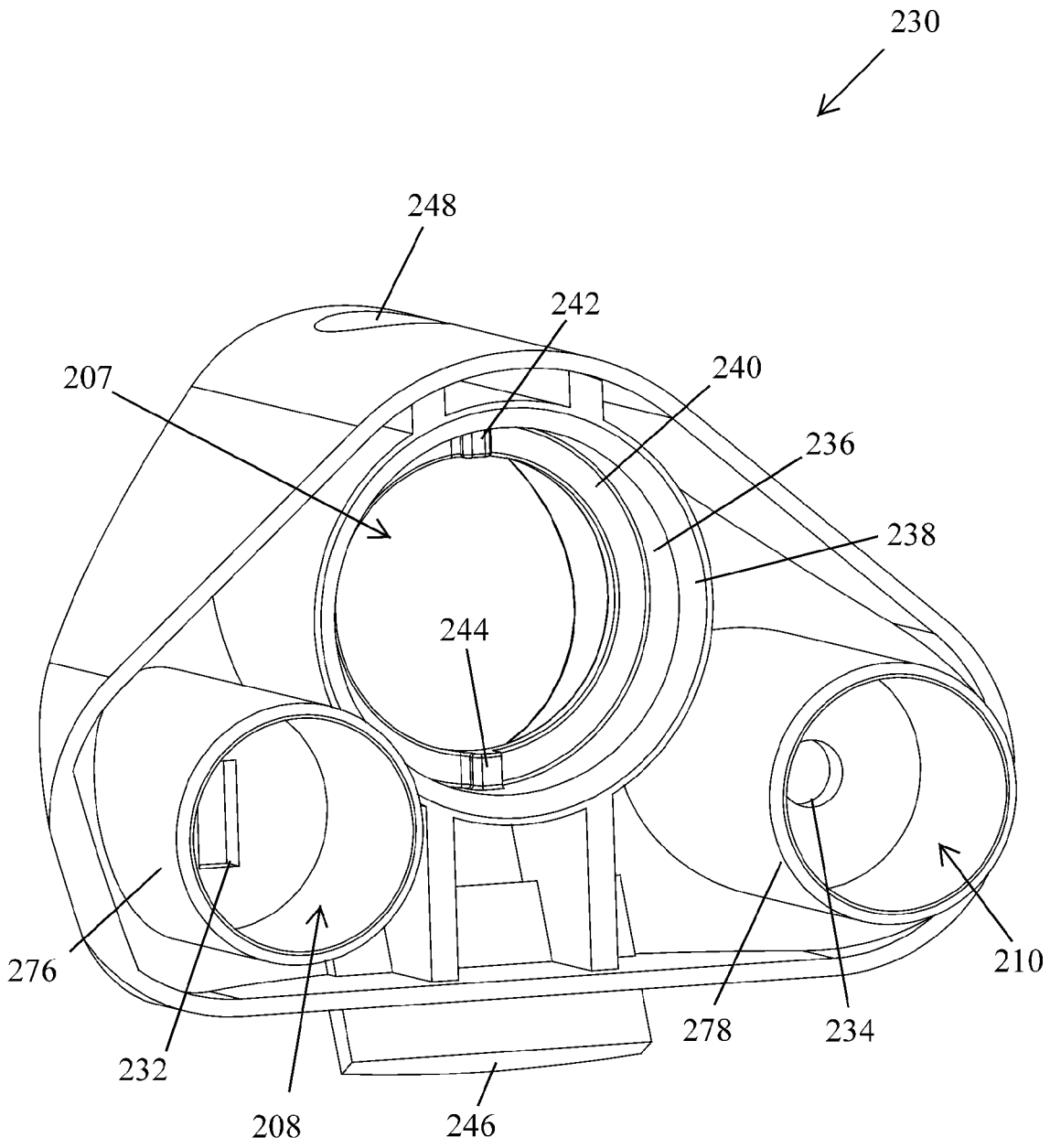
FIG. 17 is a rear perspective view of an embodiment of a nozzle carrier.

As illustrated in FIG. 17, the nozzle carrier 230 can include a plurality of nozzle ports in a nozzle carrier body. For example, the nozzle carrier 230 can include one primary nozzle port 207. The primary nozzle port 207 can be configured to receive (e.g., releasably receive) a primary nozzle 250. In some embodiments, the primary nozzle port 207 includes a primary port axis extending substantially along a centerline of the primary nozzle port 207. In some embodiments, the nozzle carrier 230 includes one or more secondary nozzle ports. For example, the nozzle carrier 230 can include a first secondary nozzle port 208 and a second secondary nozzle port 210.

In some cases, nozzles of various spray ranges and/or spray patterns can be used in the same nozzle carrier 230. For example, the nozzle carrier 230 can include a short-range nozzle (e.g., a first secondary nozzle) configured to output water within a first range from the sprinkler on which the nozzle carrier 230 is installed. The carrier 230 can include a mid-range nozzle (e.g., a second secondary nozzle) configure to output water within or in a second range greater further from the sprinkler than the first range. In some cases, the carrier 230 includes a long range nozzle (e.g., primary nozzle 250) configured to output water within a third range further from the sprinkler than the second range. According to some variants, the primary nozzle 250 functions as the short-range nozzle or as the mid-range nozzle. In some embodiments, one or more of the nozzles of the carrier 230 is configured to output in a radial pattern having wider coverage (e.g., covering an area with a larger circumferential width) than one or more of the other nozzles in the carrier 230.

In some embodiments, as illustrated in FIGS. 14 and 17, the nozzle carrier 230 can include a head water nozzle 232. The head water nozzle 232 (e.g., short-range nozzle) can be removably mated with one or more of the first and second secondary nozzle ports 208, 210. In some embodiments, the head water nozzle 232 is formed (e.g., injection molded or otherwise formed) as an integral part with one or more of the first and secondary nozzle ports 208, 210. The nozzle carrier 230 can include two head water nozzles 232, each mated or integral with one or more of the secondary nozzle ports 208, 210. Each head water nozzle 232 can be configured to distribute water to cover an area within approximately 25 feet of the sprinkler on which it is installed. In some cases, one or more of the head water nozzles 232 is configured to distribute water to cover an area within approximately 30 feet, within approximately 10 feet, within approximately 45 feet, and/or within approximately 75 feet of the sprinkler. Many variations are possible.

In some embodiments, the nozzle carrier 230 includes a mid-range secondary nozzle 234. The mid-range secondary nozzle 234 can be removably mated with one or more of the first and second secondary nozzle ports 208, 210. In some embodiments, the mid-range secondary nozzle 234 is formed (e.g., injection molded or otherwise formed) as an integral part with one of the first and secondary nozzle ports 208, 210. The nozzle carrier 230 can include two mid-range secondary nozzles 234, each mated or integral with one of the secondary nozzle ports 208, 210. Each mid-range secondary nozzle 234 can be configured to distribute water to cover an area between approximately 20 feet and 40 feet from the sprinkler on which it is installed. In some cases, one or more of the mid-range secondary nozzles 234 is configured to distribute water to cover an area from about 10 feet to 60 feet, from about 30 feet to about 55 feet, from about 45 feet to 80 feet, and/or from about 75 feet to 90 feet from the sprinkler. Many variations are possible.

In some embodiments, the primary nozzle 250 is configured to distribute water from about 40 to 50 feet from the sprinkler on which it is installed. The primary nozzle 250 can be configured to distribute water from about 30 to 45 feet, from about 45 to 60 feet, from about 50 to 90 feet, from about 90 to 110 feet, from about 40 to 85 feet, and/or further than 100 feet from the sprinkler. Many variations are possible.

In some cases, multiple (e.g., 2, 3, 4, 5, 6, or more) primary nozzles 250 (e.g., having varying outlet sizes and/or shapes) are packaged with a sprinkler to facilitate installation of a customized primary nozzle for a particular sprinkler. For example, a single nozzle carrier 230 can be configured to couple with multiple primary nozzles having differing spray patterns, output ranges, flow rates, trajectories, and/or other features. In some cases, multiple nozzle carriers 230 can be configured to mate with a standard cavity 204. The multiple carriers can differ in port size, number of ports, and/or other features. For example, some carriers may have larger primary ports than others to accommodate larger/higher flow rate primary nozzles. In some cases, the secondary port sizes and/or secondary nozzles of varying carriers can vary.

Figure 18:
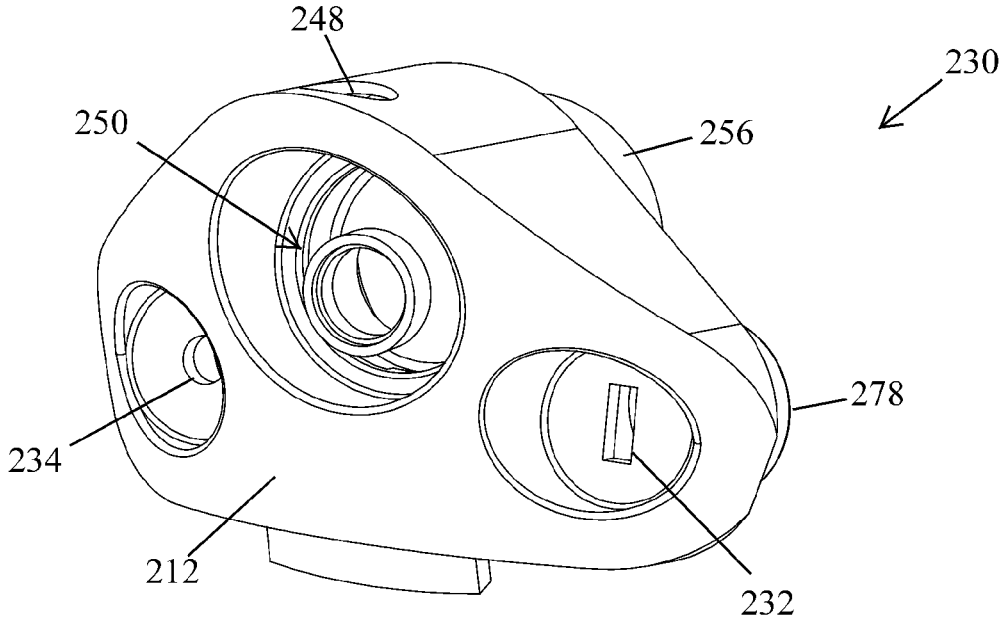
FIG. 18 is a front perspective view of a primary nozzle inserted into the nozzle carrier of FIG. 17.
Figure 19:
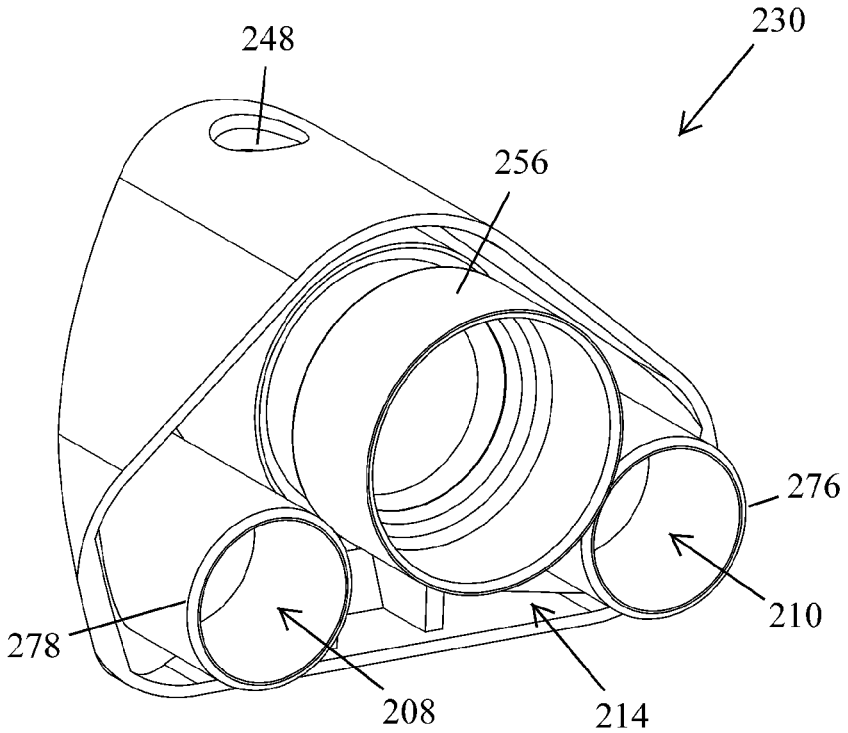
FIG. 19 is a rear perspective view of the assembly of FIG. 18.

As illustrated in FIGS. 18 and 19 nozzle ports 207, 208, 210 can extend through a front side 212 (e.g., outer face or front surface) and back side 214 (e.g., inner face or back surface) of the nozzle carrier 230. In some embodiments, the nozzle ports 207, 208, 210 include mating structures configured to engage with mating structures in the nozzle recess 204 of the nozzle housing 226. In some embodiments, engagement between the mating structures of each of the nozzle ports 207, 208, 210 and the corresponding mating structures in the nozzle recess 204 of the nozzle housing 226 inhibit or prevent water leakage from an interior of the nozzle housing 226 other than through the nozzle ports 207, 208, 210.

In some embodiments, the mating structure on one or more of the nozzle ports 207, 208, 210 (e.g., and/or the nozzles installed in the respective nozzle ports 207, 208, 210) is a flange extending from the respective port into the recess 204 when the nozzle carrier 230 is mated with the nozzle housing 226. For example, the primary nozzle 250 can include a flange 256 extending into the nozzle recess 204. The first secondary nozzle 208 can include a flange 278 extending into the nozzle recess 204. In some cases, the second secondary nozzle 210 can include a flange 276 extending into the nozzle recess 204. One or more of the flanges 278, 276 can have a generally cylindrical shape, a generally prismatic shape (e.g., triangular prism, rectangular prism), and/or a generally oval shape.

Figure 16:
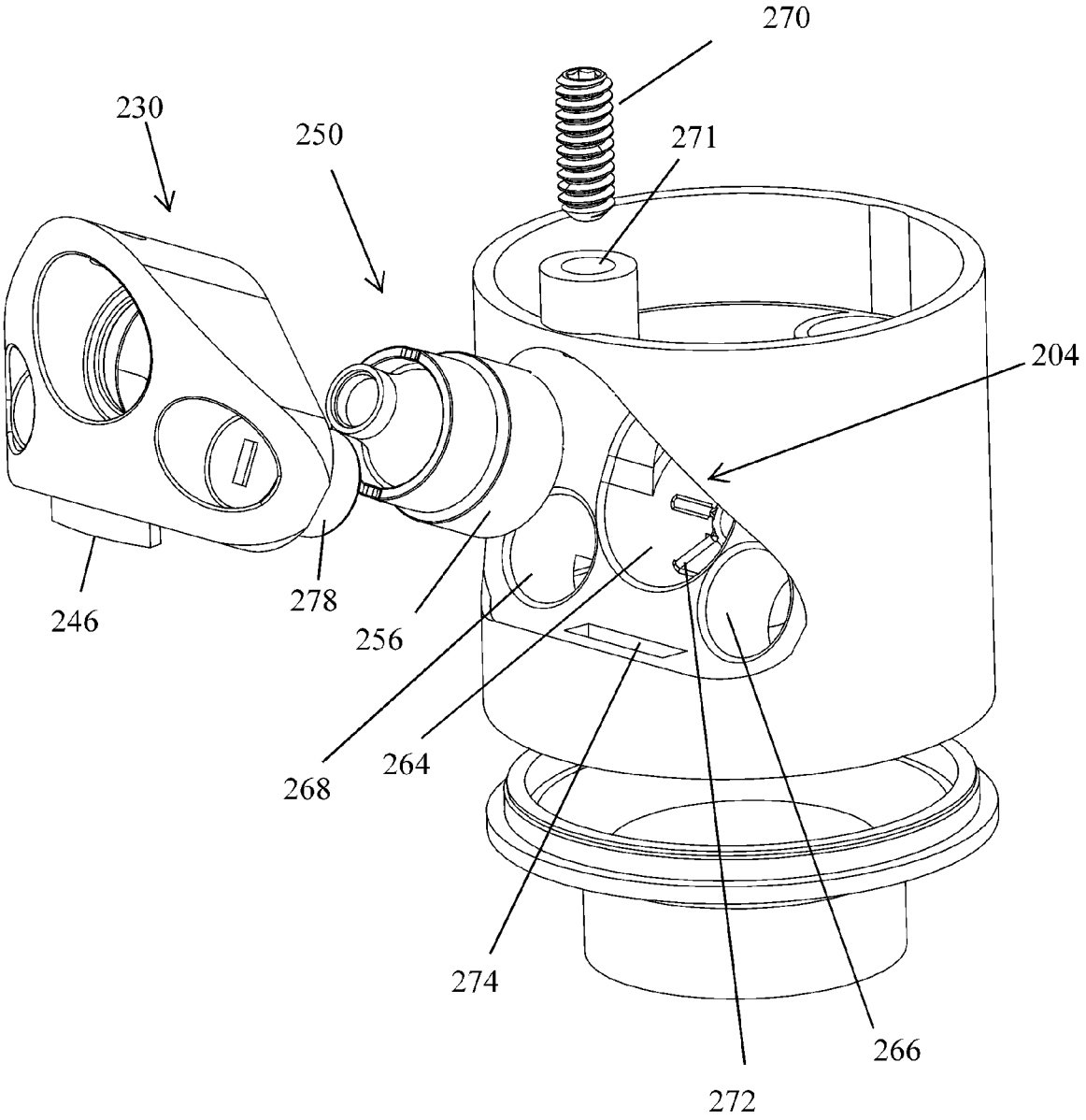
FIG. 16 is an exploded front perspective view of the assembly of FIG. 14.

As illustrated in FIG. 16 the mating structures in the nozzle recess 204 can include one or more bores sized and shaped to receive the respective flanges 278, 276 of the nozzle ports 208, 210 and/or the flange 256 of the primary nozzle 250. For example, the nozzle recess 204 can include a primary bore 264 sized and shaped to receive the flange 256 of the primary nozzle 250. The nozzle recess 204 can include a first secondary bore 266 sized and shaped to receive at least a portion of the flange 278 of the first secondary nozzle port 208. In some embodiments, the nozzle recess 204 includes a second secondary bore sized and shaped to receive at least a portion of the flange 276 of the second secondary nozzle 210. The respective fits between the flanges 278, 276 and bores 266, 268 (e.g., and between flange 256 and bore 264) can be tight enough to create a seal between the structures. For example, the respective fits can be tight enough to inhibit or prevent water from escaping from the interior of the nozzle housing 230 other than through the nozzle ports 207, 208, 210. In some embodiments, the respective fits are tight enough to inhibit or prevent inadvertent disconnection between the nozzle carrier 230 and the nozzle housing 226 without the use of any further mechanisms or methods of connection between the nozzle housing 230 and the nozzle housing 226.

Figure 21:
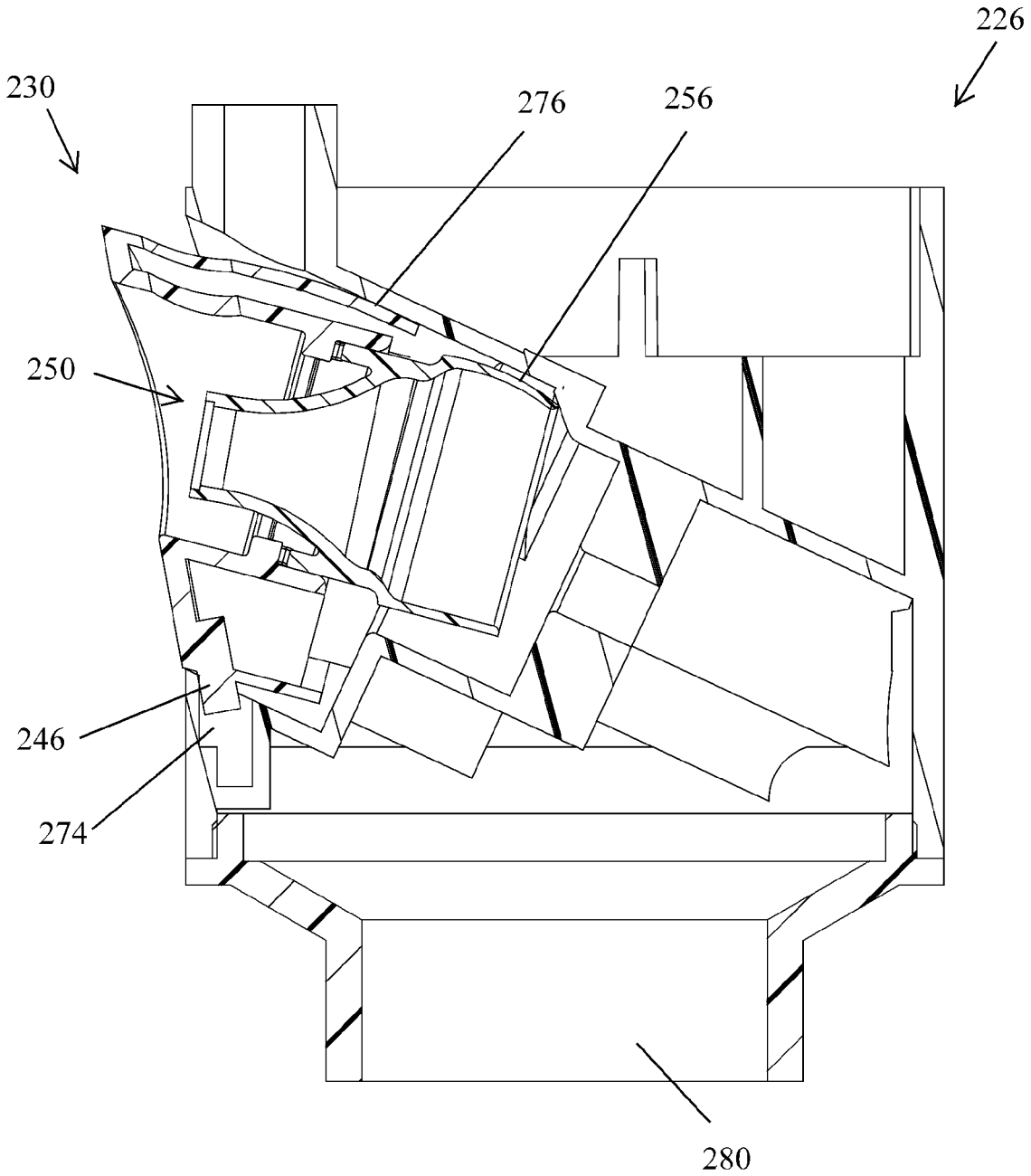
FIG. 21 is a cross-sectional view of the assembly of FIG. 14 along the cut plane A-A of FIG. 15 wherein the nozzle carrier of FIG. 17 is partially installed.

As illustrated in FIGS. 16 and 21, the nozzle carrier 230 can include one or more coupling structures configured to facilitate coupling with a coupling structure in the nozzle recess 204. For example, the nozzle carrier 230 can include a tab 246. The tab 246 can extend downward from the nozzle carrier 230. In some embodiments, the nozzle recess 204 includes a slot 274 sized and shaped to receive the tab 246. Reception of the tab 246 by the slot 274 can inhibit or prevent inadvertent decoupling between the nozzle carrier 130 and the recess 204. The tab 246 can be constructed from a flexible or semi-flexible material configured to permit bending of the tab 246 during installation and/or removal of the nozzle carrier 230 into/out of the recess 204.

Figure 20:
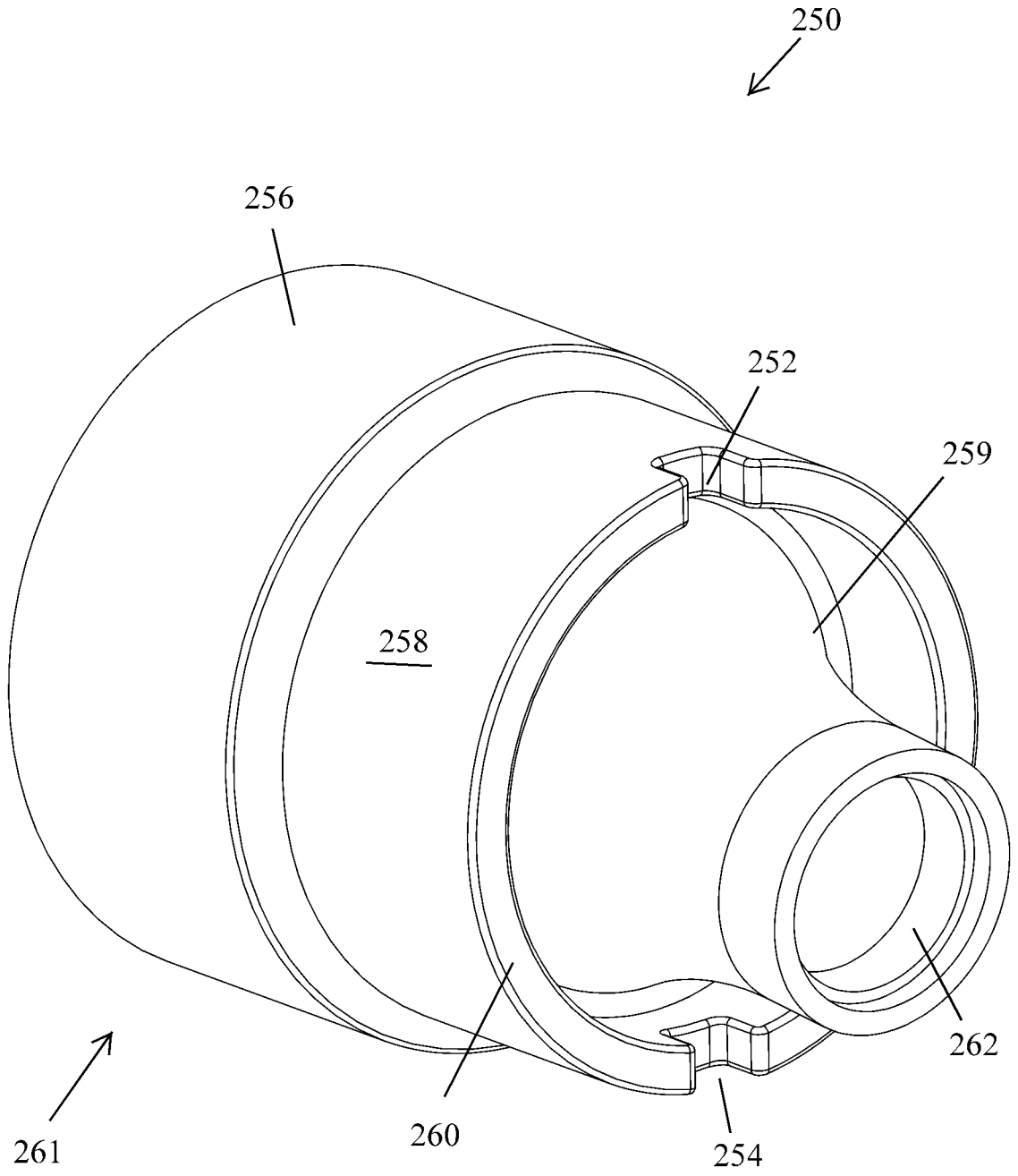
FIG. 20 is a front perspective view of an embodiment of a primary nozzle.

As illustrated in FIG. 20, the primary nozzle 250 can include a body portion 261. The body portion 261 can define an inlet to the primary nozzle 250. The body portion 261 can be connected to a tapered portion 259 (e.g., outlet portion). In some embodiments, the body portion 261 is connected to a shroud 258 that extends toward and around the tapered portion 259. The shroud 258 can overlap at least a portion of the tapered portion 259. In some embodiments, the shroud 258 has a generally cylindrical shape. In some embodiments, the tapered portion 259 is connected to and/or extends from a front end of the shroud 258. In some embodiments, the primary nozzle 250 does not include a shroud 258.

In some embodiments, the primary nozzle 250 is configured to releasably mate with the nozzle carrier 230 from the back side 214 of the carrier 230. As illustrated in FIGS. 17 and 18, the primary nozzle port 207 and/or primary nozzle 250 can include one or more orientation structures. The orientation structures of the primary nozzle port 207 and primary nozzle 250 can be configured to inhibit rotation of the primary nozzle 250 with respect to the nozzle carrier 230 when the primary nozzle 250 is mated with the nozzle carrier 230. In some embodiments, the orientation structures of the primary nozzle port 207 and primary nozzle 250 are configured to permit the primary nozzle 250 to mate with the nozzle carrier 230 in a plurality of rotational configurations.

As illustrated in FIG. 17, the port 207 can include a rear-facing flange 240. The rear-facing flange 240 can limit the extent to which primary nozzle 250 is inserted into the nozzle carrier 230 from the back side 214. In some embodiments, the flange 240 can extend around an inner perimeter of the primary nozzle port 207. The flange 240 can include one or more recesses, nubs, breaks, gaps, protrusions 242, 244, or other orientation structures. For example, the flange 240 can include two protrusions 242, 244. The two protrusions 242, 244 can be positioned 180° from each other around a perimeter of the flange 240.

In some embodiments, as illustrated in FIG. 20, the shroud 261 can be sized and shaped to fit at least partially within the primary nozzle port 207. In some cases, a base portion 261 (e.g., inlet portion) of the primary nozzle 250 is sized and shaped to fit at least partially within the primary nozzle port 207. In some embodiments, the shroud 261 (e.g., a face 260 thereof) or some portion of the base portion 261 or tapered portion 259 of the primary nozzle 250 abuts the flange 240 of the primary nozzle port 207 when the primary nozzle 250 is mated with the primary nozzle port 207. The shroud 258, or some other portion of the primary nozzle 250, can include one or more recesses 252, 254, nubs, breaks, gaps, protrusions, or other orientation structures configured to engage with the orientation structure (e.g., protrusions 242, 244) of the primary nozzle port 306. For example, as illustrated, the shroud 258 can include two recesses 252, 254 positioned 180° from each other around a perimeter of the face 260. In some embodiments, using two protrusions 242, 244 and two recesses 252, 254 as described above can facilitate mating of the primary nozzle 250 with the nozzle port 207 in two rotational orientations, 180° apart rotationally.

As illustrated in FIGS. 16 and 21, the nozzle carrier 230 can include one or more coupling structures configured to facilitate coupling with a coupling structure in the nozzle recess 204. For example, the nozzle carrier 230 can include a tab 246. The tab 246 can extend downward from the nozzle carrier 230. In some embodiments, the nozzle recess 204 includes a slot 274 sized and shaped to receive the tab 246. Reception of the tab 246 by the slot 274 can inhibit or prevent inadvertent decoupling between the nozzle carrier 130 and the recess 204. The tab 246 can be constructed from a flexible or semi-flexible material configured to permit bending of the tab 246 during installation and/or removal of the nozzle carrier 230 into/out of the recess 204. In some embodiments, the nozzle turret assembly 200 includes one or more fasteners configured to secure the nozzle carrier 230 to the nozzle housing 226. For example, the assembly 200 can include a screw 270 (e.g., a set screw, shown in FIGS. 16 and 21). The screw 270 can be inserted through a hole 271 through a portion (e.g., a top portion) of the nozzle housing 226 and through a hole 248 in a portion of the nozzle carrier 230 to lock the nozzle carrier 230 to the nozzle housing 226. The nozzle carrier 230 and/or cavity 204 can be sized and shaped to permit insertion of the tab 246 at least partially into the slot 274 when the nozzle carrier 230 is initially inserted into the cavity 204. The remainder of the nozzle carrier 230 can be rotated about the tab 246 into engagement with the cavity 240. In some embodiments, the base portion 261/flange 256 of the primary nozzle 250 is constructed from a flexible or semi-flexible material. The flange 256 and/or the tab 246 can be configured to deflect, as illustrated in FIG. 21, when the nozzle carrier 230 is initially inserted into the cavity 204.

Figure 22:
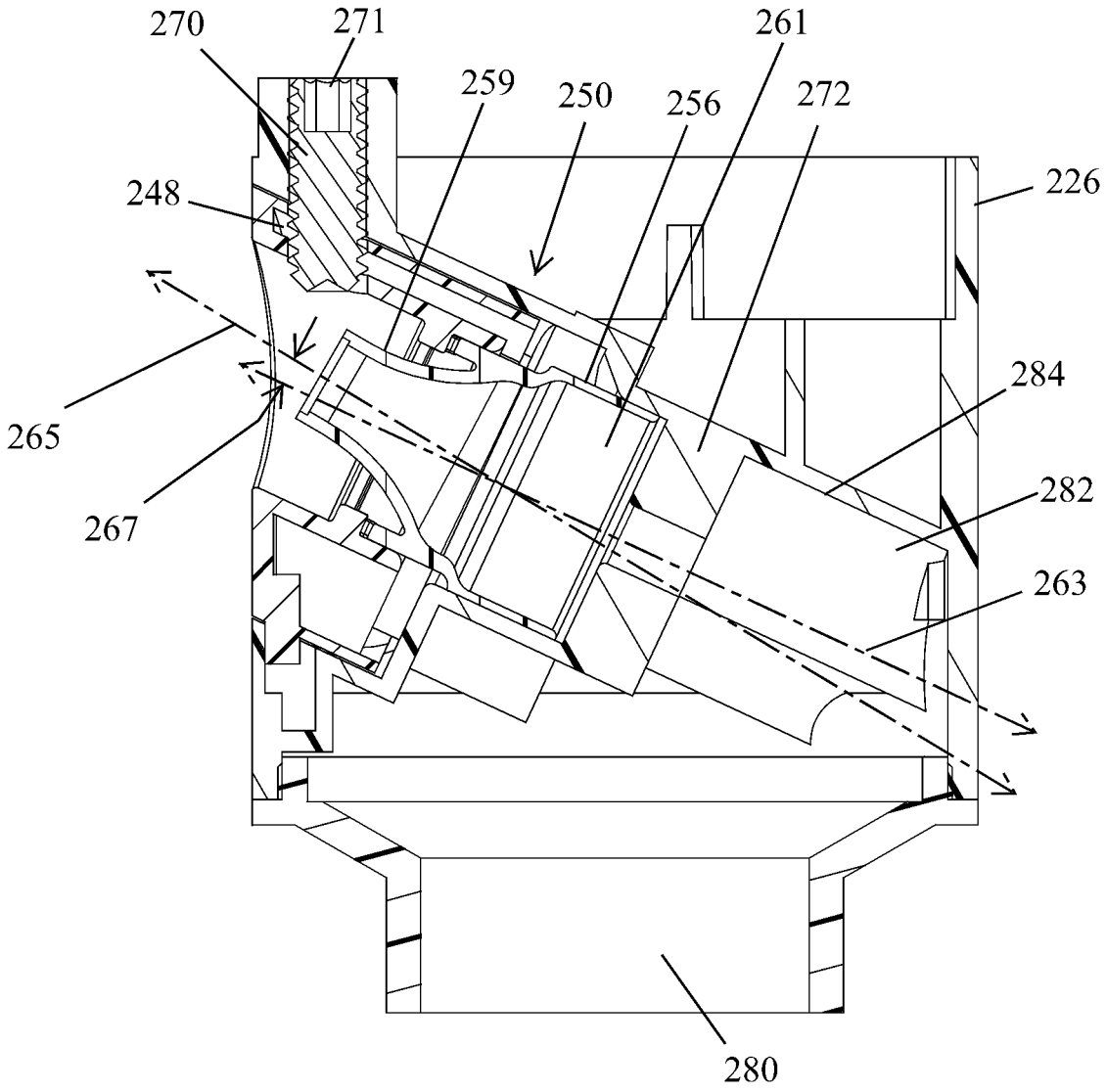
FIG. 22 is a cross-sectional view of the assembly of FIG. 14 along the cut plane A-A of FIG. 15 wherein the primary nozzle is installed with an upward trajectory.

As illustrated in FIG. 22, upon full insertion of the nozzle carrier 230 into the cavity 240, the flange 256 can be received within the bore 264. The bore 264 can include one or more fins 272 (see FIGS. 20 and 22) extending inward from an inner wall of the bore 264. The fins 272 can be configured to redirect and straighten water flow through the interior of the nozzle housing 226 into the primary nozzle 250. In some cases, each of the bores 264, 266, 268 includes one or more flow-straightening fins. In some embodiments, the fins (e.g., fins 272) are removable from the respective bores 264, 266, 268. In some cases, the fins are formed as part of or are permanently attached to the interior walls of the bores 264, 266, 268. The fins 272 can perform as an abutment structure to limit the extent to which the primary nozzle 250 (e.g., the base portion 261) can be inserted into the bore 264. For example, the fins 272 can be positioned such that a back end of the base portion 261/flange 256 abuts the fins 272. Abutment between the primary nozzle 250 and the fins 272 and flange 240 can reduce or eliminate movement of the primary nozzle 250 with respect to the nozzle housing 226 and nozzle carrier 230 when the nozzle carrier 230 is mated with the nozzle housing 226. In some cases, another structure in the recess 204 (e.g., a flange, protrusions, or other structure) serves as an abutment structure to limit the extent to which the primary nozzle 250 can be inserted into the bore 264. In some cases, abutment between the primary nozzle 250 and the fins 272 and flange 240 can reduce or eliminate a need for detents, clips, or other attachment structures to secure the nozzle 250 into place within the nozzle housing 226. In some cases, the fins 272 may be water-straightening fins. In some cases, the fins 272 may be positioned in the flow path where the water changes direction and may reduce the turbulence of the water as the water enters the primary nozzle 250. In some embodiments, the fins 272 may be placed downstream of where the water changes direction.

The base portion 261 of the primary nozzle 250 can define a first flow path through the nozzle 250. The first flow path of the primary nozzle 250 can be substantially (e.g., within ±10°) parallel to a central axis 263 (e.g., inlet axis) of the base portion 261 of the nozzle 250. The tapered portion 259 can define a second flow path through the nozzle 250. The second flow path through the primary nozzle 250 can be substantially parallel to a central axis 265 (e.g., outlet axis) of the tapered portion 259. The central axis 265 of the tapered portion 258 can be non-parallel to the central axis of the base portion 261. In some embodiments, an angle 267 between the central axis 265 of the tapered portion 259 and the central axis 263 of the base portion 261 is greater than 2°, greater than 4°, greater than 8°, greater than 13°, greater than 20°, and/or greater than 30°. In some cases, the angle 267 is approximately 5°. Many variations are possible.

Figure 23:
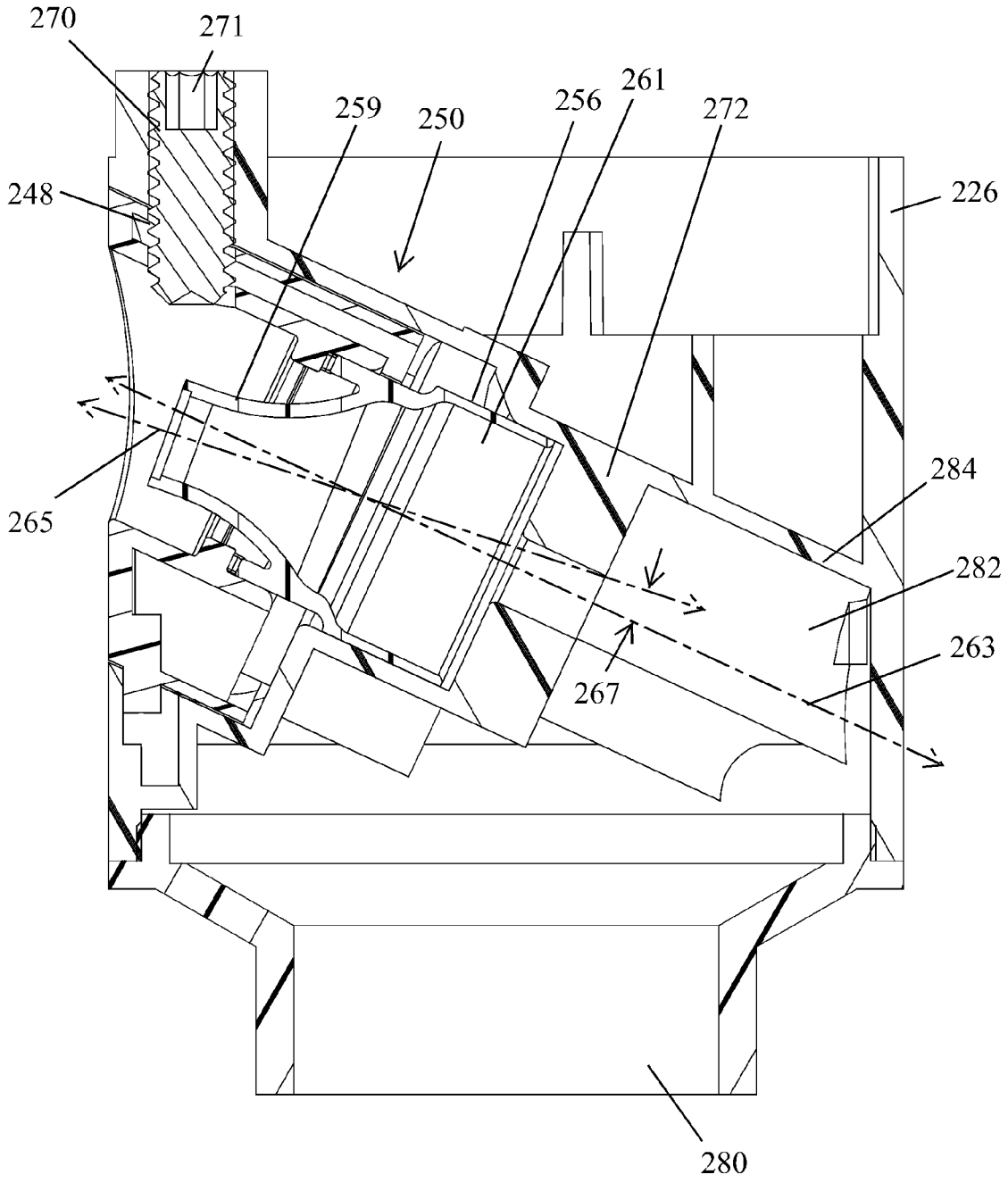
FIG. 23 is a cross-sectional view of the assembly of FIG. 14 along the cut plane A-A of FIG. 15 wherein the primary nozzle is installed with a downward trajectory.

The tapered portion 259 can be configured to point upward (e.g., by the angle 267) with respect to the base portion 261 of the primary nozzle 250 when the primary nozzle 250 is installed in a first rotational orientation (e.g., see FIG. 22). In some embodiments, the tapered portion 259 is configured to point downward (e.g., by the angle 267) with respect to the base portion 261 of the primary nozzle 250 when the primary nozzle 250 is installed in a second rotational orientation (e.g., see FIG. 23). The difference in trajectory of the tapered portion 259 between the first and second rotational configurations can be approximately equal to double the angle 267 between the tapered portion 259 and the base portion 261.

As illustrated in FIGS. 21 and 22, the nozzle housing 226 can include a nozzle turret inlet 280. The nozzle turret inlet 280 can be upstream from a primary nozzle chamber 282. The primary nozzle chamber 282 can include a chamber wall 284. The chamber wall 284 can be semi-annular in shape. In some embodiments, the chamber wall 284 inhibits or prevents passage of water past the primary nozzle 250 (e.g., beyond the leading edge of the body portion 261 of the primary nozzle 250 with respect to the turret inlet 280) other than through the fins 272 and/or through the first flow path as defined by the base portion 261 of the primary nozzle 250. In some such case, turbulence within the nozzle housing 226 and through the primary nozzle 250 is reduced, as all of the water contacting the base portion 261 of the nozzle 250 is directed through the nozzle 250.

FIGS. 24-27 illustrate another embodiment of a nozzle turret assembly 300. Many of the features of the assembly 300 are the same as or similar to the features of the nozzle turret assembly 200 discussed above. As such, like reference numbers are used for unchanged features between the nozzle turret assembly 200 and the nozzle turret assembly 300.

Figure 24:
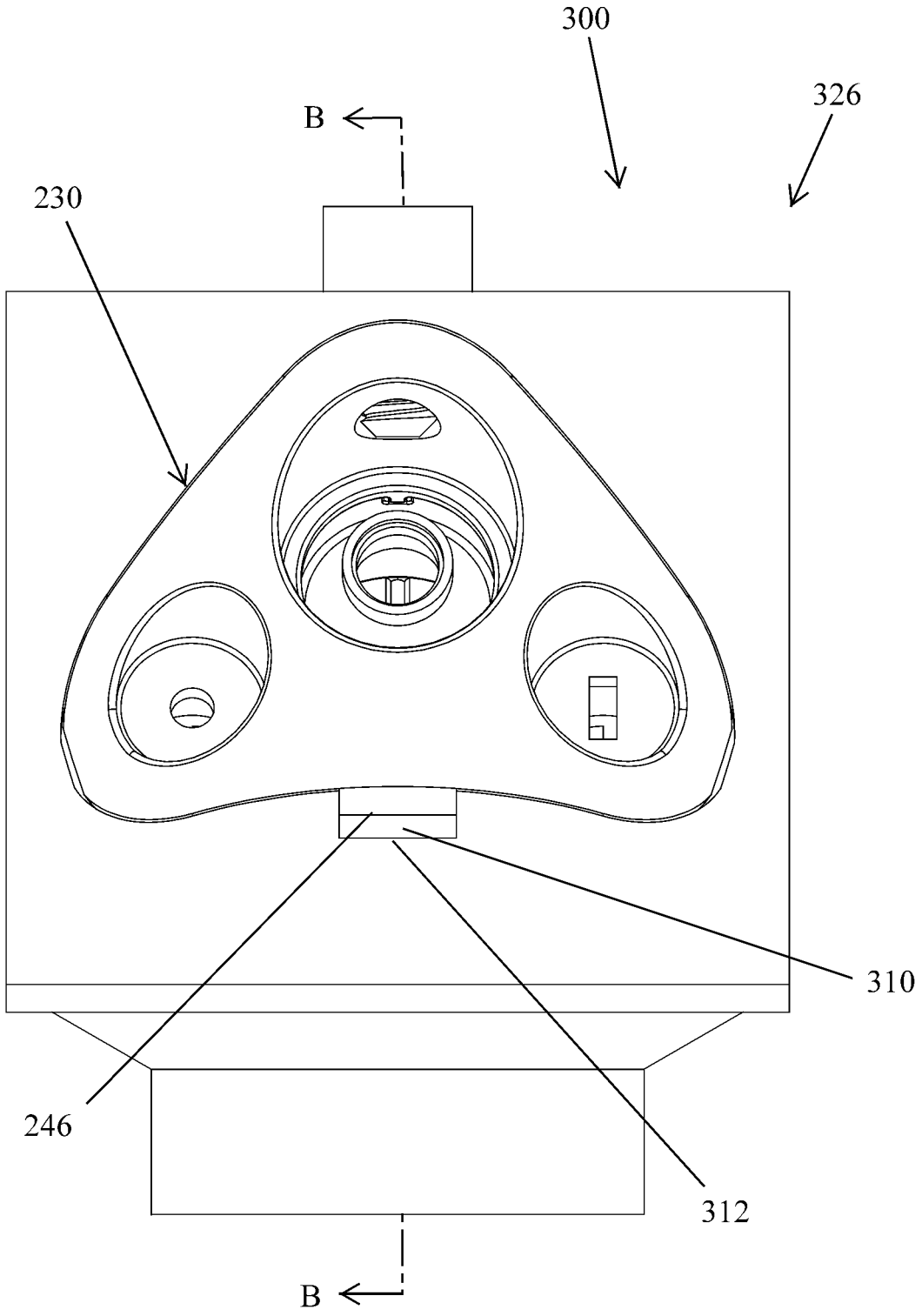
FIG. 24 is a front plan view of another nozzle turret assembly.
Figure 25:
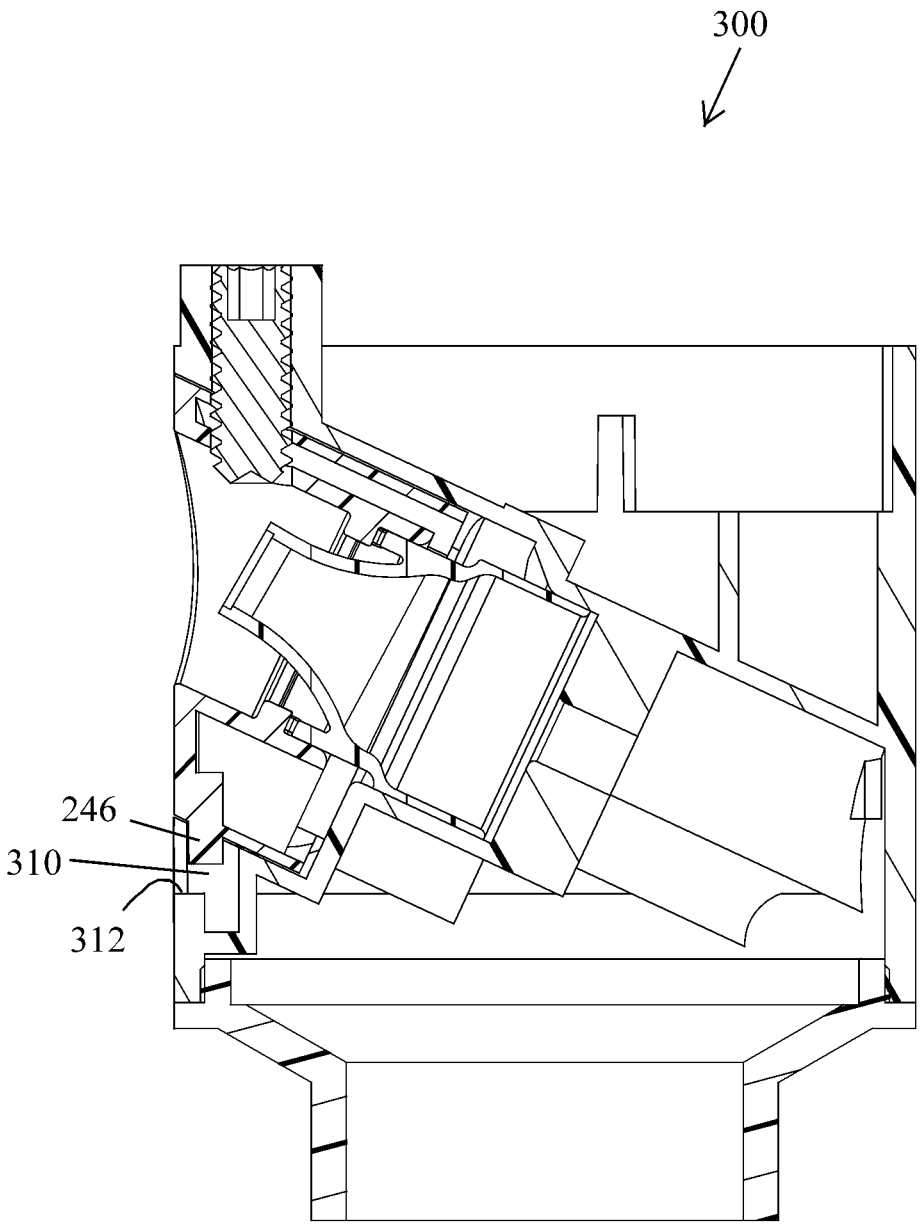
FIG. 25 is a cross-sectional view of the assembly of FIG. 24 along the cut plane B-B of FIG. 24.
Figure 26:
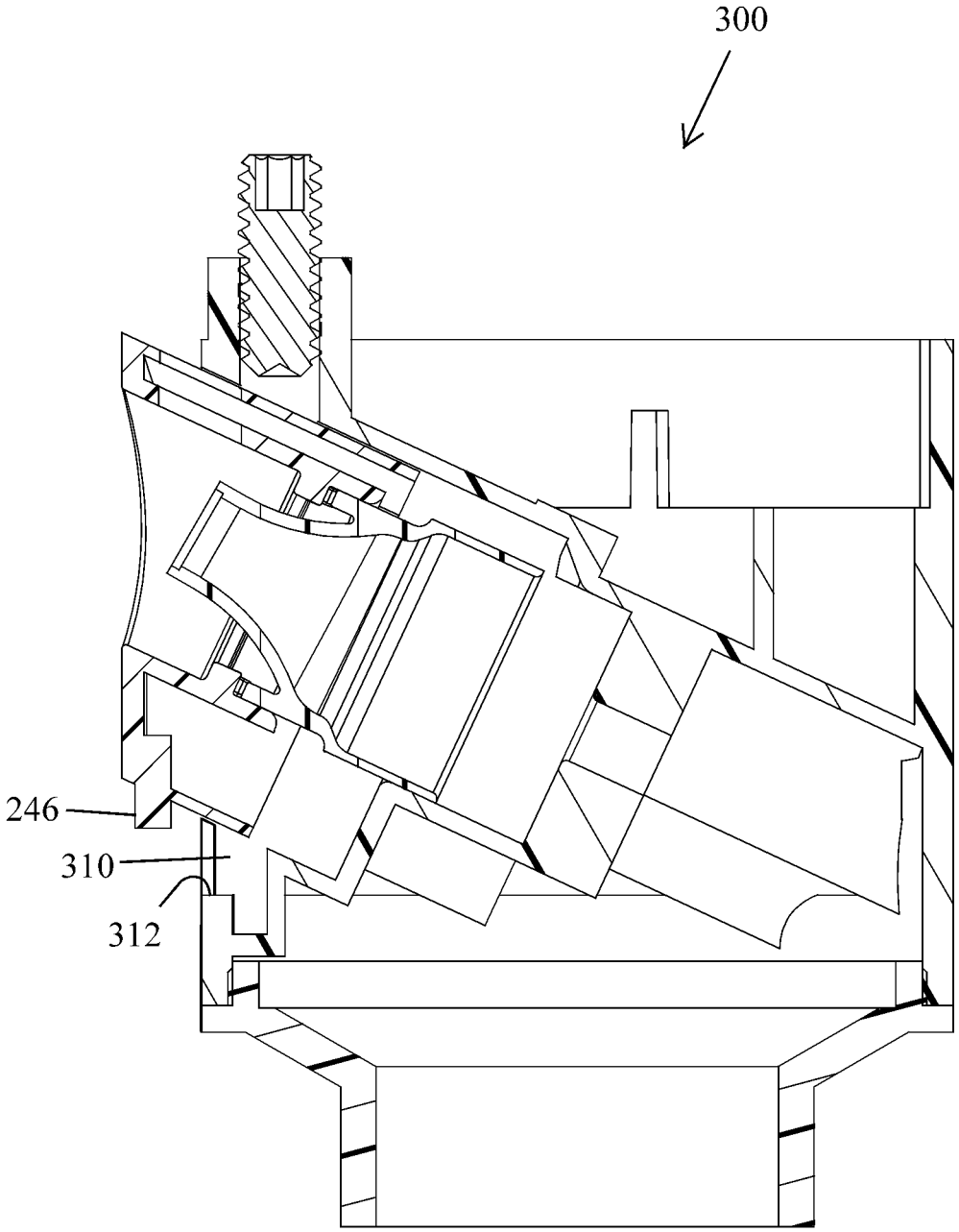
FIG. 26 is a cross-sectional view of the assembly of FIG. 24 along the cut plane B-B of FIG. 24 wherein the nozzle carrier is partially installed.
Figure 27:
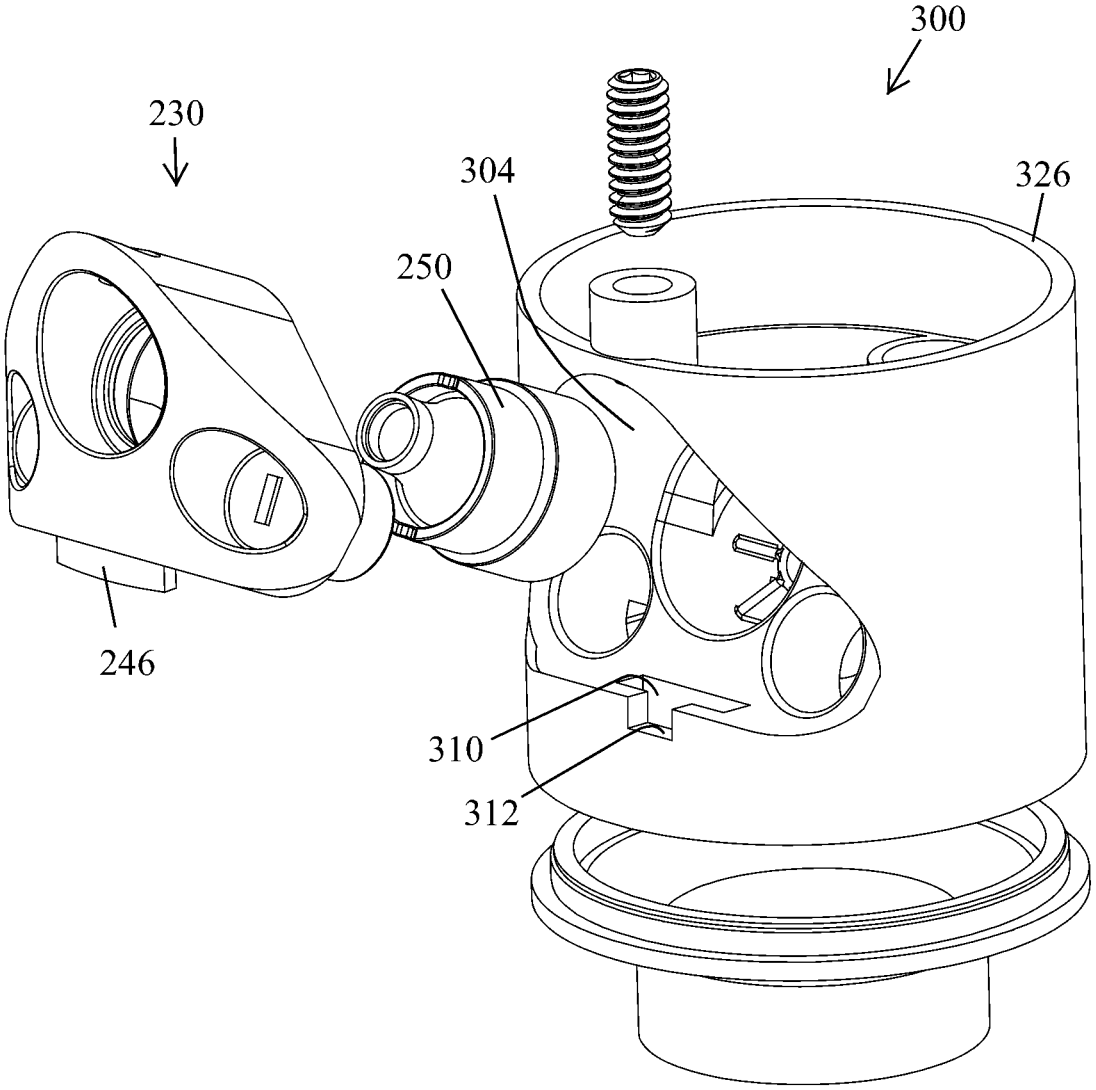
FIG. 27 is an exploded front perspective view of the assembly of FIG. 24.

As illustrated in FIG. 24, the nozzle housing 326 can include a slot 310 having a cut-away portion 312. The cut-away portion 312 can facilitate access to the tab 246 of the nozzle carrier 230 when the nozzle carrier 230 is mated with the nozzle housing 326. For example, during removal of the nozzle carrier 230 from the nozzle housing 326, a portion of a tool (e.g., a screw driver or other elongate tool)

can be inserted into the cut away portion 312 to wedge the tab 246 upward and out of the slot 310. Moving the tab 246 upward and out of the slot 310 can facilitate removal of the nozzle carrier 230 from the nozzle recess 304 without rotation of the nozzle carrier 230 (e.g., such that the flanges 256, 278, 276 slide into and out of the bores 268, 264, 266 along a movement path generally parallel to the centerlines of the bores 264, 266, 268). In some cases, the tool can be used to deflect the tab 246 during insertion of the nozzle carrier 230 into the recess 304.

While we have described and illustrated in detail several embodiments of a nozzle for a sprinkler that optimally changes the trajectory of the water leaving the nozzle, it should be understood that our inventions can be modified in both arrangement and detail. For example, the sprinkler 10 could be modified to a simplified pop up or shrub configuration without the valve 16, outer case 18, valve actuator components 19 and housing 20. The nozzle turret 26 could be driven by any type of gear drive mechanism. The sprinkler may be designed to operate in a fixed arc of rotation, an adjustable arc of rotation, or a full circle rotation. The angle of the exit port 66 can be modified to be greater or less than twenty degrees relative to the horizontal. The angular change within the nozzle 14 can be greater or less than five degrees. The nozzle 14 may be constructed of one piece, or multiple pieces assembled together, to obtain the desired results. There may be more or fewer stream straightening fins 84 and 92 in the inlet or outlet sections. There may be stream straighteners only in the base, and not in the outlet, or in the outlet and not in the base, or no stream straighteners at all in the nozzle. The fins 84 in the inlet section may connect at the center and not require the center bore 86. There may be additional stream straightening members in the nozzle turret 26. The nozzle 14 may be retained in the nozzle turret 26 by a screw, clips, or other retention means. The retainer cavities 72*a* and 72*b* on the nozzle 14 may be larger or smaller or of a different shape to mate with a different retention device. There may be more than two retainer cavities to allow the nozzle to be inserted in more than two radial orientations. In one example, a third retainer cavity may exist ninety degrees from 72*a* and 72*b* to allow the sprinkler to work at fifteen, twenty, or twenty-five degree trajectories. The nozzle may be constructed with no retention cavities at all so the nozzle can be inserted in in infinite number of positions to allow for an infinite trajectory adjustment between its uppermost and lowermost settings. The shape of the exterior base 80 may be of any design to mate with the outlet port 66 of nozzle turret 26. Therefore the protection afforded our inventions should only be limited in accordance with the following claims.

What is claimed is:

1. A nozzle turret assembly for an irrigation sprinkler, the nozzle turret assembly comprising:

a nozzle housing;

a nozzle carrier configured to releasably mate with the nozzle housing, the nozzle carrier comprising:

an outer face facing away from the nozzle housing when the nozzle carrier is mated with the nozzle housing;

an inner face positioned at least partially within the nozzle housing when the nozzle carrier is mated with the nozzle housing;

a primary nozzle port extending through the outer face and the inner face of the nozzle carrier and having a primary port axis; and a first secondary nozzle port extending through the outer face and the inner face of the nozzle carrier; and a primary nozzle configured to releasably mate with the primary nozzle port of the nozzle carrier, the primary nozzle comprising an inlet portion defining an inlet axis and a tapered outlet portion connected to the inlet portion and defining an outlet axis, the tapered outlet outputting water in a trajectory parallel to the outlet axis, the inlet axis being parallel to the primary port axis and the outlet axis being non-parallel to the primary port axis.

2. The nozzle turret assembly of claim 1, wherein the primary nozzle is configured to releasably mate with the primary nozzle port of the nozzle carrier in a first orientation and in a second orientation, wherein the primary nozzle outputs water at a higher trajectory in the first orientation than in the second orientation.

3. The nozzle turret assembly of claim 1, wherein the first secondary nozzle port includes a head water nozzle configured to output water up to a first distance and a second secondary nozzle port including a mid-range secondary nozzle configured to output water up to a second distance, the second distance being greater than the first distance.

4. The nozzle turret assembly of claim 3, wherein the mid-range secondary nozzle is configured to output water between a third distance and the second distance, wherein the third distance is less than or equal to the first distance.

5. The nozzle turret assembly of claim 4, wherein the primary nozzle is configured to output water between a fourth distance and a fifth distance, wherein the fourth distances is less than or equal to the second distance, and wherein the fifth distance is greater than the second distance.

6. The nozzle turret assembly of claim 1, wherein the nozzle carrier includes:

a second secondary nozzle port extending through the outer face and the inner face of the nozzle carrier;

a first secondary nozzle; and a second secondary nozzle;

wherein one or more of the first and second secondary nozzles are configured to releasably mate with one or more of the first and second secondary nozzle ports, and wherein each of the primary nozzle, first secondary nozzle, and second secondary nozzle is mated with or released from the nozzle housing when the nozzle carrier is mated with or released from the nozzle housing.

7. A nozzle turret assembly for an irrigation sprinkler, the nozzle turret assembly comprising:

a nozzle turret housing having a turret interior, a first end configured to mate with a riser assembly of an irrigation sprinkler, a second end, a housing axis extending between the first end and the second end of the nozzle turret, at least one lateral wall spaced from the housing axis, a carrier cavity in the at least one lateral wall and open to an exterior of the nozzle turret, a primary nozzle bore in the carrier cavity; and at least one secondary nozzle bore;

a nozzle carrier configured to couple with the carrier cavity in the at least one lateral wall of the nozzle turret housing, the nozzle carrier comprising:

a primary nozzle port; and a first secondary nozzle port separate from the primary nozzle port and configured to align with the at least one secondary nozzle bore; and a primary nozzle having an inlet and an outlet, an axial centerline of the inlet being non-parallel to an axial centerline of the outlet, the primary nozzle configured to couple with the primary nozzle bore in the carrier cavity and to extend through at least a portion of the primary nozzle port when the primary nozzle and nozzle carrier are coupled with the carrier cavity.

8. The nozzle turret assembly of claim 7, wherein the primary nozzle port includes a flange configured to limit a distance the primary nozzle can be inserted into the primary nozzle port.

9. The nozzle turret assembly of claim 7, wherein the primary nozzle bore includes an abutment structure configured to limit a distance the primary nozzle can be inserted into the primary nozzle port.

10. The nozzle turret assembly of claim 7, wherein the primary nozzle is configured to couple with the primary nozzle bore and with the primary nozzle port without any attachment structure.

11. The nozzle turret assembly of claim 7, wherein:

the primary nozzle port includes one or more orientation structures, the primary nozzle includes one or more orientation structures, and the one or more orientation structures of the primary nozzle port are configured to engage with the one or more orientation structures of the primary nozzle to inhibit rotation of the primary nozzle with respect to the primary nozzle port when the primary nozzle is coupled with the primary nozzle port and the nozzle carrier is coupled with the carrier cavity.

12. The nozzle turret assembly of claim 11, wherein the orientation structures of the primary nozzle port and of the primary nozzle include at least one protrusion and at least one recess configured to couple with the at least one protrusion.

13. A nozzle turret assembly for an irrigation sprinkler, the nozzle turret assembly comprising:

a nozzle housing having a sidewall;

a cavity within the nozzle housing and accessible through an opening in the sidewall;

a primary nozzle bore in the cavity, the primary nozzle bore having an inner wall;

a nozzle carrier configured to releasably mate with the nozzle housing, the nozzle carrier comprising:

a nozzle carrier body having a front surface and a back surface, wherein the back surface is positioned at least partially within the cavity when the nozzle carrier is mated with the nozzle housing; and a primary nozzle port extending through the front and back surfaces of the nozzle carrier body; and a primary nozzle having a base portion having a central axis and defining an inlet, and a tapered portion having a central axis non-parallel to the central axis of the base portion, the tapered portion connected to the base portion and defining an outlet of the primary nozzle, the primary nozzle configured to fit at least partially within the primary nozzle port from the back surface of the nozzle carrier body.

14. The nozzle turret assembly of claim 13, wherein the nozzle housing includes a water inlet and a primary nozzle chamber in fluid communication with the primary nozzle bore and with the water inlet, wherein the primary nozzle chamber includes a chamber wall defining at least a portion of the primary nozzle bore, wherein the base portion of the primary nozzle is configured to fit at least partially within the primary nozzle bore, and wherein the chamber wall is configured to inhibit passage of water beyond a leading edge of the base portion of primary nozzle other than through inlet of the primary nozzle.

15. The nozzle turret assembly of claim 13, wherein one or more flow-straightening fins extend inwardly from the inner wall of the primary nozzle bore.

16. The nozzle turret assembly of claim 13, comprising a secondary nozzle bore in the cavity.

17. The nozzle turret assembly of claim 13, comprising a slot formed within the cavity, the slot at least partially defined by the sidewall of the cavity, wherein the nozzle carrier comprises a mating tab configured to releasably connect to the slot.

18. The nozzle turret assembly of claim 17, wherein the mating tab is configured to flex during installation and during removal of the nozzle carrier from the nozzle housing.

19. The nozzle turret assembly of claim 17, wherein the base portion of the primary nozzle is configured to flex during installation and during removal of the nozzle carrier from the housing when the primary nozzle is installed in the primary nozzle port.

20. The nozzle turret assembly of claim 17, wherein the slot includes a cut-away portion sized and shaped to permit insertion of a tool between the tab and a wall of the slot during installation and during removal of the nozzle carrier from the housing.

* * * * *